US007568243B2

(12) United States Patent
Gehr et al.

(10) Patent No.: US 7,568,243 B2
(45) **Date of Patent: *Aug. 4, 2009**

(54) PLAYARD

(75) Inventors: Arthur L. Gehr, East Earl, PA (US); Michael L. Longenecker, Ephrata, PA (US); Robert T. Pike, Reading, PA (US); Gregory S. Sellers, Christiana, PA (US); Joshua E. Clapper, King of Prussia, PA (US); Jonathan M. Pacella, Coatesville, PA (US)

(73) Assignee: Graco Children's Products Inc., Exton, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/184,905

(22) Filed: Aug. 1, 2008

(65) Prior Publication Data

US 2008/0289103 A1 Nov. 27, 2008

Related U.S. Application Data

(60) Division of application No. 10/995,532, filed on Nov. 24, 2004, now Pat. No. 7,418,746, which is a continuation-in-part of application No. 10/446,132, filed on May 28, 2003, now Pat. No. 6,865,756.

(51) Int. Cl.
*A47D 7/00* (2006.01)

(52) U.S. Cl. ..... 5/99.1; 5/98.1

(58) Field of Classification Search ..... 5/99.1, 5/98.1, 93.1, 98.2, 182; 256/25; 135/145, 135/96

See application file for complete search history.

(56) References Cited

U.S. PATENT DOCUMENTS 927,738 A 7/1909 Malaby (Continued)

FOREIGN PATENT DOCUMENTS

EP 1 481 617 12/2004

(Continued)

OTHER PUBLICATIONS

Graco Children's Products Inc.: "Instruction Manual: Pack 'n Play Sport Playard 9920—Graco ISPP034AC 05/04" Internet Instruction Manual, [Online] Oct. 25, 2004, Retrieved from the Internet: URL:http://web.archive.org/web/20041025002518/http://www.gracobaby.com/assets/pdfs/instructions/ISPP034AC.pdf>.

(Continued)

*Primary Examiner*—Alexander Grosz
(74) *Attorney, Agent, or Firm*—Lempia Braidwood LLC

(57) ABSTRACT

A playard includes a frame structure movable between an open arrangement and a folded arrangement. The frame structure includes a plurality of pivot joints arranged in an upper set and a lower set, each pivot joint in the upper set being positioned over a corresponding pivot joint in the lower set, and a plurality of cross members connected at respective slants to the upper and lower sets of pivot joints. The playard further includes a plurality of top rails, each top rail being attached to adjacent pivot joints in the upper set. The frame structure lacks legs to support the upper set of pivot joints at an elevation above the lower set of pivot joints. The elevation decreases as the respective slants of the cross members change to move the frame structure from the folded arrangement to the open arrangement until the top rails are under tension.

13 Claims, 27 Drawing Sheets

U.S. PATENT DOCUMENTS

| | | | | |
|---|---|---|---|---|
| 1,950,603 | A | | 3/1934 | Fischer |
| 2,698,443 | A | | 1/1955 | Ralick |
| 2,974,325 | A | | 3/1961 | Mango |
| 3,430,273 | A | * | 3/1969 | Stillwaugh ..... 5/98.1 |
| 3,789,439 | A | | 2/1974 | Berg et al. |
| 4,186,454 | A | | 2/1980 | Cone |
| 4,483,026 | A | | 11/1984 | Kassai |
| 4,683,600 | A | | 8/1987 | Beger |
| 4,739,527 | A | | 4/1988 | Kohus et al. |
| 4,967,432 | A | | 11/1990 | Kujawski et al. |
| 5,241,716 | A | | 9/1993 | Kohus |
| 5,384,925 | A | | 1/1995 | Vail |
| 5,697,111 | A | | 12/1997 | Dillner et al. |
| 5,711,040 | A | | 1/1998 | Huang |
| 5,961,180 | A | | 10/1999 | Greger et al. |
| 6,035,877 | A | | 3/2000 | Losi et al. |
| 6,058,528 | A | | 5/2000 | Yang |
| 6,067,676 | A | | 5/2000 | Carnahan et al. |
| 6,125,483 | A | | 10/2000 | Stroud et al. |
| 6,343,390 | B1 | | 2/2002 | Yang et al. |
| 6,421,850 | B1 | | 7/2002 | Welsh |
| 6,438,773 | B1 | | 8/2002 | Hsia |
| 6,550,801 | B1 | | 4/2003 | Newhard |
| 2002/0016991 | A1 | | 2/2002 | Brown et al. |
| 2003/0061658 | A1 | | 4/2003 | Longnecker |
| 2005/0150046 | A1 | | 7/2005 | Gehr et al. |
| 2005/0166316 | A1 | | 8/2005 | Gehr et al. |

FOREIGN PATENT DOCUMENTS

| | | |
|---|---|---|
| FR | 1 053 010 | 1/1954 |
| FR | 2 361 846 | 4/1978 |
| FR | 2 769 815 | 4/1999 |

OTHER PUBLICATIONS

Translation of FR 2 769 815.
Photographs of DeWalt Saw Horse for DeWalt Compound Miter Saw.
International Search Report of PCT/US2004/039612 dated Aug. 26, 2005.

* cited by examiner

PLAYARD

CROSS-REFERENCES TO RELATED APPLICATIONS

This application is a divisional of U.S. application Ser. No. 10/995,532, now issued as U.S. Pat. No. 7,418,746, entitled "Playard" and filed Nov. 24, 2004, which, in turn, is a continuation-in-part of U.S. application Ser. No. 10/446,132, now issued as U.S. Pat. No. 6,865,756, entitled "Playard" and filed May 28, 2003, the disclosures of which are incorporated herein by reference in their entirety.

BACKGROUND OF THE DISCLOSURE

1. Field of the Disclosure

This invention relates to a playard. More specifically, this invention relates to a collapsible playard and a collapsible frame structure and latch assembly for the playard.

2. Description of Related Art

Various types of collapsible frame structures for a juvenile product, such as a playpen, cot or bed, are known.

One known frame structure, for example, is for a portable playpen. The frame structure includes top rails, a plurality of rods arranged in X-shaped pairs equal in number to the sides of the playard, and a locking hinge arranged between each respective top rail of the playpen and a pivot point of the respective rod pairs.

Another known frame structure, suitable for a playpen or cot, includes four upper frame joints and four lower frame joints pivotably connected to frame legs, where the upper frame joints and lower frame joints are respectively located in the upper and lower corners to form a box structure. The box structure also includes a bottom base frame with four legs radially extending from a central coupling joint that allows the four legs to fold relative to the central joint and that facilitates the collapse of the entire structure.

There is a need in the art for a frame structure that may be unfolded to encompass a relatively large area, yet also provides sufficient protection and containment for a child inside the playard and remains light weight for good portability.

SUMMARY OF THE DISCLOSURE

An aspect of the present invention relates to a collapsible frame structure. The structure comprises a plurality of legs; a plurality of cross members arranged in pairs, each pair of cross members extending between respective adjacent legs; a plurality of slider joints, each slider joint slidingly engaging a respective one of the legs and pivotably attached to two adjacent cross members; a plurality of pivot joints, each pivot joint at a respective one of the legs to pivotably attach two adjacent cross members; and at least one latch mechanism configured to selectively engage at least one of the slider joints with a respective leg.

Another aspect of the present invention relates to a latch assembly for maintaining a playard in an open arrangement. The latch assembly comprises a slider joint slidingly engaging a leg of the playard; a handle pivotably attached to the slider joint; a first latch member configured to be attached to the leg; and a second latch member attached to the handle and configured to engage the first latch member to prevent the slider joint from sliding relative to the leg.

Another aspect of the present invention relates to a collapsible frame structure for a playard. The collapsible frame structure comprises a plurality of legs; a plurality of cross members arranged so that at least one cross member extends between, and is pivotally connected to, respective adjacent legs to form a side of the playard; a plurality of slider joints, each slider joint slidingly engaging a respective one of the legs; a plurality of pivot joints, each pivot joint on a respective one of the legs; and at least one latch mechanism configured to selectively engage at least one of the slider joints with its respective leg, wherein each cross member is mounted to the respective adjacent legs by the slider joint on a first of the respective adjacent legs and by the pivot joint on a second of the respective adjacent legs.

Another aspect of the present invention relates to a playard, the playard comprising a collapsible frame structure which comprises a plurality of legs; a plurality of cross members arranged so that at least one cross member extends between, and is pivotally connected to, respective adjacent legs to form a side of the playard; a plurality of slider joints, each slider joint slidingly engaging a respective one of the legs; a plurality of pivot joints, each pivot joint on a respective one of the legs; and at least one latch mechanism configured to selectively engage at least one of the slider joints with its respective leg, wherein each cross member is mounted to the respective adjacent legs by the slider joint on a first of the respective adjacent legs and by the pivot joint on a second of the respective adjacent legs; and a fabric enclosure mounted to and supported by the collapsible frame structure.

Another aspect of the present invention relates to a playard. The playard comprises a collapsible frame structure and a fabric enclosure. The collapsible frame structure is movable between a folded arrangement and an open arrangement. The collapsible frame structure comprises a plurality of legs; and at least three interconnected sides between respective adjacent legs, each side including a pair of connected cross members that pivot in relation to one another, the interconnected sides together with the legs defining an interior of the collapsible frame structure, wherein the interior of the collapsible frame structure is free of frame joints. The fabric enclosure is mounted to and supported by the collapsible frame structure, wherein the collapsible frame structure is movable between the open and folded arrangement with the fabric enclosure mounted thereto.

Another aspect of the present invention relates to a collapsible frame structure movable between a folded arrangement and an open arrangement. The collapsible frame structure comprises: a plurality of cross members arranged to form sides of the frame structure; a plurality of first pivot joints, each first pivot joint pivotably attached to first ends of respective of the cross members; a plurality of second pivot joints, each second pivot joint pivotably attached to second ends, opposite to the first ends, of respective of the cross members; and a plurality of flexible rails, each flexible rail fixedly attached to two adjacent first pivot joints such that when the collapsible frame structure is in the open arrangement each rail is tensioned so as to prevent the collapsible frame structure from further opening.

Another aspect of the present invention relates to a collapsible frame structure. The collapsible frame structure comprises a plurality of sides; and a plurality of legs, each side arranged between respective of the legs, each leg having a telescoping mechanism configured to allow the length of the leg to be adjusted and a locking mechanism configured to lock the leg at a predetermined height.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and, together with the description, serve to explain the principles of the invention.

DETAILED DESCRIPTION OF THE DISCLOSURE

Reference will now be made in detail to presently preferred embodiments of the invention, examples of which are illustrated in the accompanying drawings. An effort has been made to use the same reference numbers throughout the drawings to refer to the same or like parts.

Figure 1:
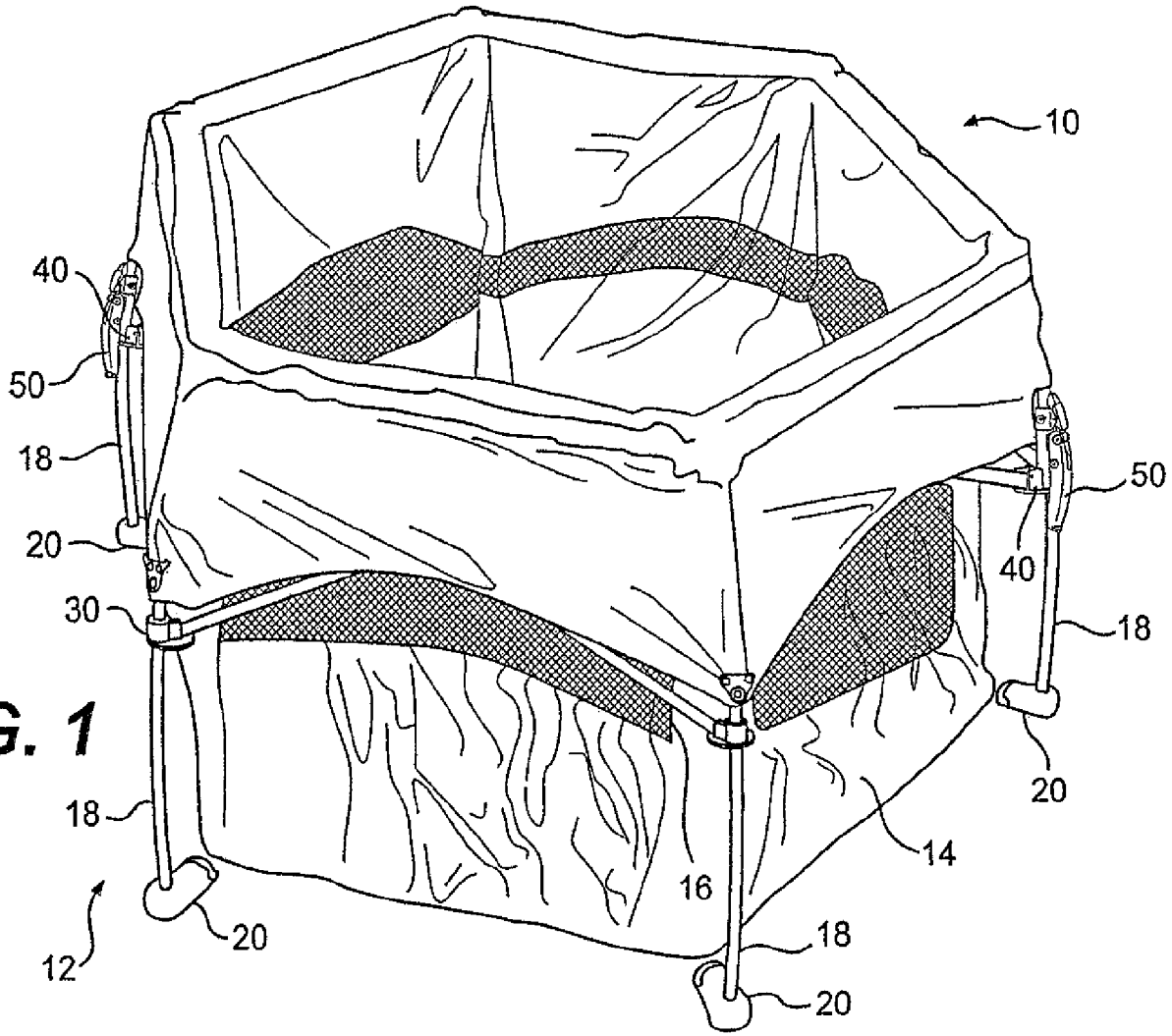
FIG. 1 is a perspective view that illustrates a playard according to an exemplary embodiment of the present invention.

FIG. 1 illustrates a playard 10 including a collapsible frame structure 12 according to an exemplary embodiment of the invention. The playard 10 also includes a soft goods or fabric enclosure 14 mounted to and supported by the collapsible frame structure 12. The present playard may be unfolded to encompass a relatively large area, yet still provides sufficient protection and containment for a child within the playard, as well as being relatively light weight and collapsible for storage. Thus, the playard provides a large play space while having a very compact fold. Also, the present playard is simple in construction and has fewer parts that require manual locking/unlocking than many conventional playards. The presently described playard has been designed with these considerations in mind.

The playard 10 is illustrated in FIG. 1 in a fully open arrangement. As can be seen, the playard 10 provides a secure, contained environment in which a child can play, and the playard is configured to be collapsed into a folded arrangement for travel or storage.

The enclosure 14 may be removed from the collapsible frame structure 12 and washed and cleaned. The enclosure 14 may contain a door or opening (not shown) to allow a child ingress into and egress out of the playard 10. The enclosure 14 may also include a number of windows 16, which are transparent or semitransparent, so that a child can see outside of the enclosure 14 through the windows 16. The windows 16 may comprise, for example, cloth that is thin and porous enough to be transparent or semitransparent, plastic, webbing, or mesh.

The collapsible frame structure 12 may be collapsed with or without the enclosure 14 attached. Thus, the collapsible frame structure 12 provides flexibility in not necessarily requiring that the enclosure 14 be detached prior to collapsing the collapsible frame structure 12.

Moreover, the collapsible frame structure 12 may be embodied in any size as desired. Thus, a large playard may be employed for outdoor use, while a smaller playard may be appropriate for indoor use. The collapsible nature of the frame structure 12 allows for ready transport of a playard of any size, even a larger playard.

Figure 2:
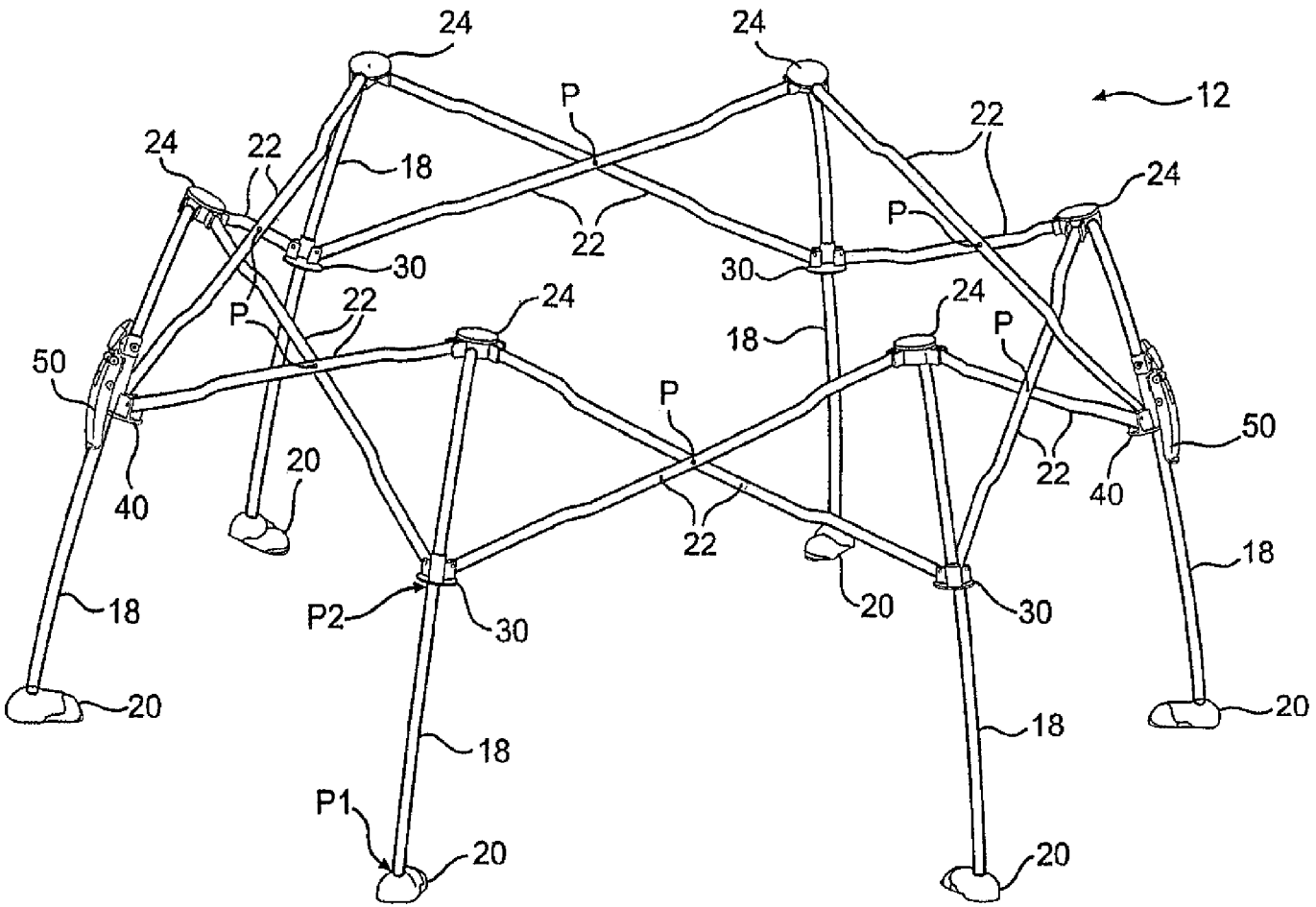
FIG. 2 is a perspective view illustrating a collapsible frame structure according to an exemplary embodiment of the present invention.

The collapsible frame structure 12 will now be described with respect to FIGS. 1 and 2. As can be seen in FIG. 2, the collapsible frame structure 12 includes a plurality of legs 18. The collapsible frame structure 12 as seen in FIG. 2 is arranged in a fully open arrangement, where the legs 18 are spaced at a distance from each other. As described below in connection with FIG. 8, the collapsible frame structure 12 may also be arranged in a folded arrangement.

Each of the legs 18 may comprise a hollow tube and may be made of plastic, metal, such as steel or aluminum, or any other suitable material. Hollow legs 18 are preferred because of their lightweight nature. This provides an advantage when the collapsible frame structure 12 is arranged in the folded arrangement and is carried, thus making the collapsible frame 12, and the playard 10, readily portable. The playard 10 has at least three legs 18, but it can have more, for example six, as shown in FIG. 2. The number of sides of the structure 12 generally is the same as the number of legs. The structure 12 may also be prismatic in shape.

The collapsible frame structure 12 may also include a plurality of feet 20, where each foot 20 is attached to and supports a respective one of the legs 18. The feet 20 may comprise metal, such as steel or aluminum, or plastic.

The collapsible frame structure 12 includes a plurality of cross members 22 arranged and extending, respectively, between adjacent legs 18. Like the legs 18, the cross members 22 may comprise hollow tubes and may be made of plastic or metal, such as steel or aluminum, or any other suitable material. Cross members 22 comprising hollow tubes are preferred because of their lightweight nature.

The plurality of cross members 22 may be arranged in pairs, where each pair of cross members 22 extends between respective adjacent legs 18. Each pair of cross members 22 may be arranged in an X-shape. In addition, each pair of cross members may be pivotally connected at pivots P so that, when the frame structure 12 is collapsed to the folded arrangement, the cross members 22 can pivot relative to each other.

Figure 4:
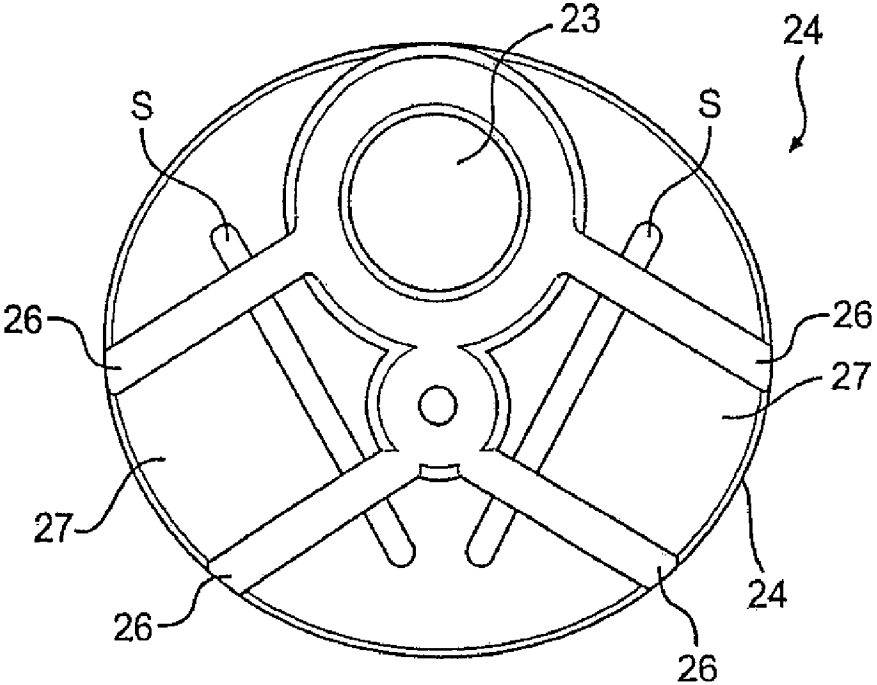
FIG. 4 is a bottom plan view of the pivot joint of FIG. 3.
Figure 17:
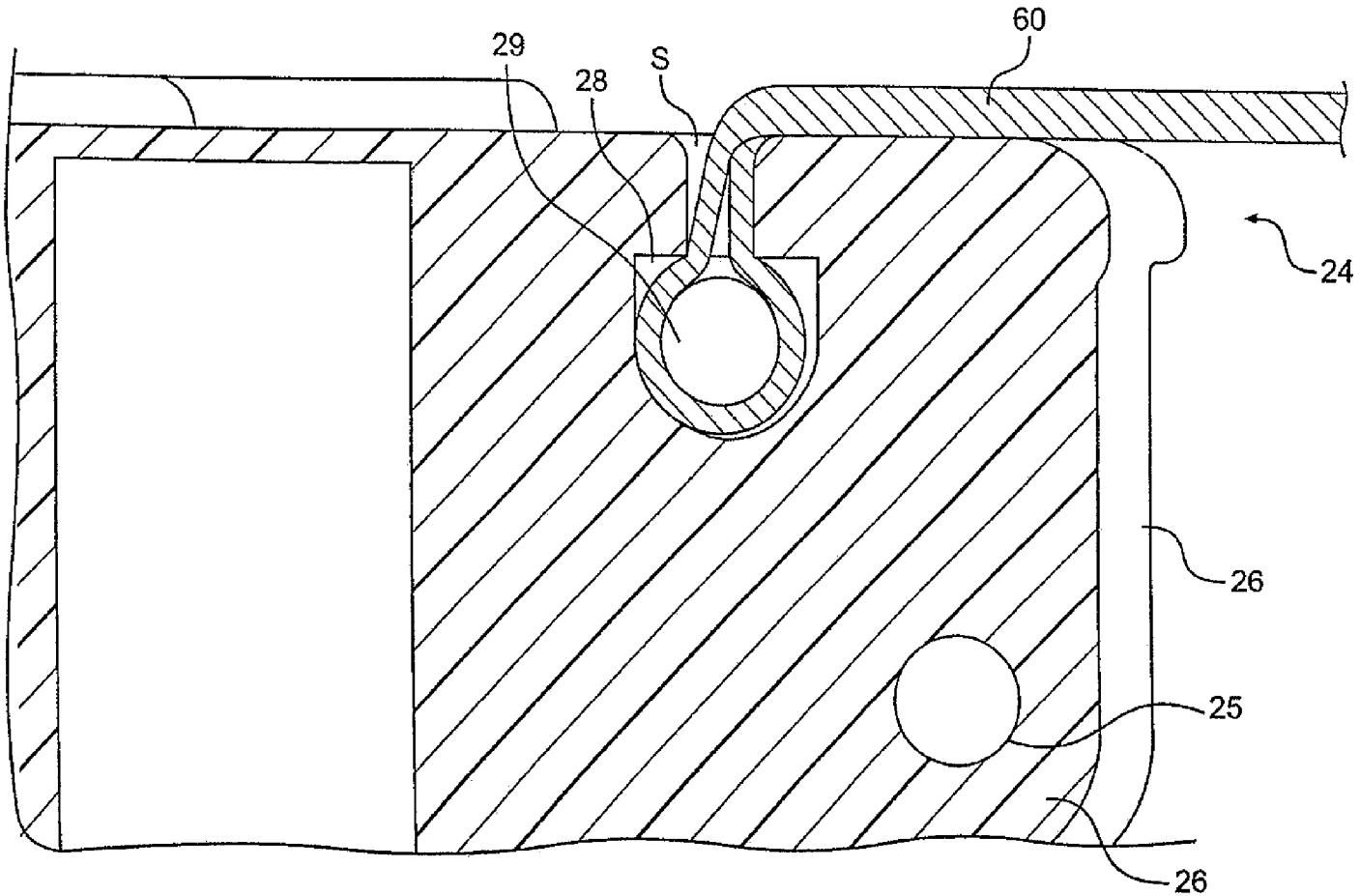
FIG. 17 is a cross-section of the pivot joint of FIG. 3 illustrating connection of a top rail to the pivot joint.
Figure 24:
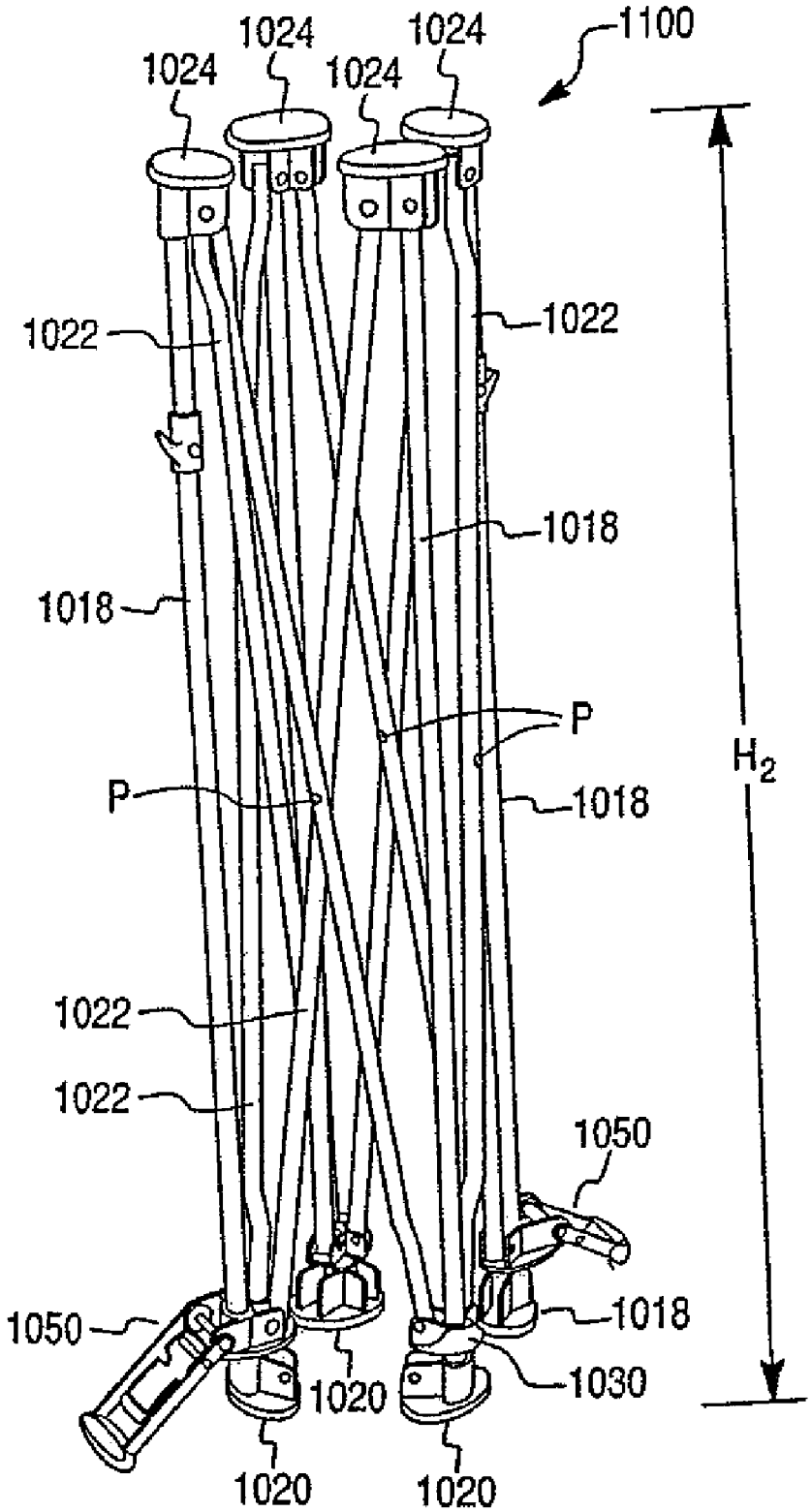
FIG. 24 is a perspective view illustrating the collapsible frame structure of FIG. 23 in a folded arrangement.

The collapsible frame structure 12 includes a plurality of pivot joints. The pivot joints function to allow the cross members 22 to pivot relative to the legs 18. In this regard, the pivot joints may simply comprise pins to attach the cross members 22 to the legs 18. Another exemplary pivot joint 24 is illustrated in FIGS. 24 and 17. FIG. 4 is a bottom plan view of the pivot joint of FIG. 3. The pivot joints 24 are arranged on each leg 18, such as on an upper end of the leg 18. In this regard, leg 18 fits into recess 23 of the pivot joint 24. Each of the pivot joints 24 is pivotably attached to at least one adjacent cross member 22. That is, an end of a cross member 22 can be positioned within a recess 27 defined by adjacent walls 26. The end of the cross member can be pivotally secured in the respective recess 27 by a pin (not shown) that passes through holes 25 in walls 26 and through the end of the cross member 22.

Figure 5:
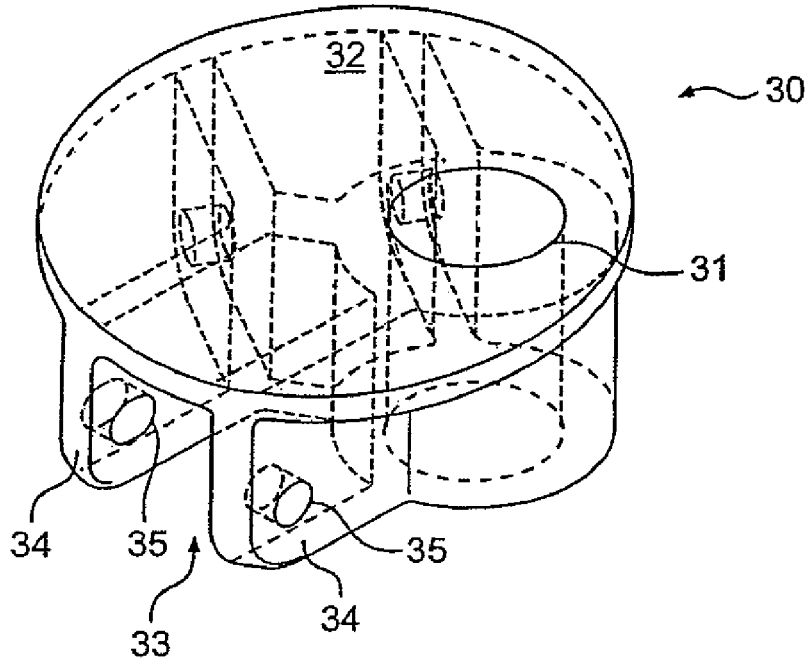
FIG. 5 is a perspective view illustrating a slider joint of the collapsible frame structure of FIG. 2.
Figure 6:
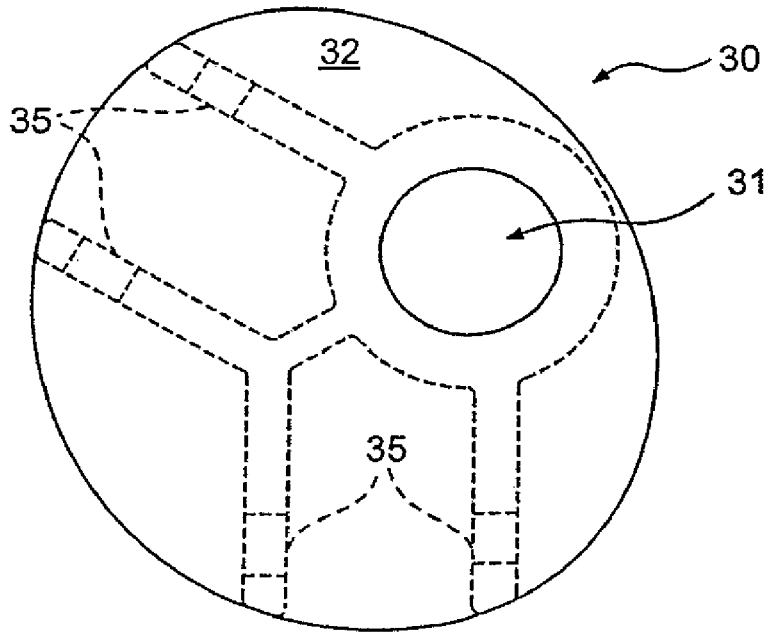
FIG. 6 is a bottom plan view of the slider joint of FIG. 5.
Figure 7:
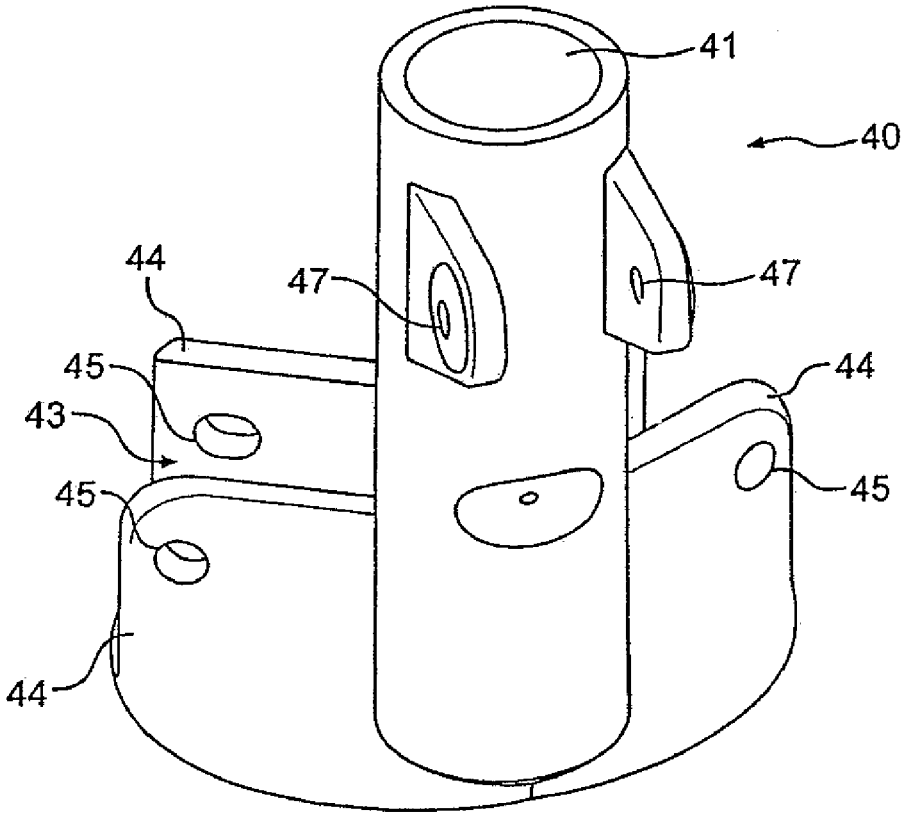
FIG. 7 is a perspective view illustrating another slider joint of the collapsible frame structure of FIG. 2.

The collapsible frame structure 12 also includes a plurality of slider joints. The slider joints function to allow an end of a respective cross member to slide up or down a respective leg to allow the frame to be opened or collapsed. Exemplary slider joints include, for example, slider joints 30, 40 as illustrated in FIGS. 1, 2, 5, 6, and 7. FIGS. 5 and 6 illustrate a slider joint 30 for those joints not attached to a latch mechanism 32 (described below). FIGS. 5 and 6 illustrate the slider joint 30 with the bottom of the joint 30 facing upward. That is, when the slider joint 30 is mounted to a leg 18, surface 32 of the joint 30 faces the foot 20 mounted to the leg 18, as shown in FIG. 2. FIG. 7 illustrates a slider joint 40 for use in conjunction with a latch mechanism 32 (described below). Each cross member 22 may be mounted to respective adjacent legs by a slider joint 30 or 40 on a first of the respective adjacent legs 18 and by the pivot joint 24 on a second of the respective adjacent legs 18. In configurations where the cross members 22 are arranged in pairs, each of the pivot joints 24 may be pivotably attached to two adjacent cross members 22, such as shown in FIG. 2.

Each of the slider joints 30, 40 slidingly engages a respective one of the legs 18. For example, the leg 18 passes through hole 31, 41 in slider joints 30, 40, respectively. The slider joints 30, 40 also are pivotably attached to at least one adjacent cross member 22. In configurations where the cross members 22 are arranged in pairs, each of the slider joints 30, 40 may be pivotably attached to two adjacent cross members 22, such as shown in FIG. 2. That is, the end of the cross member can be pivotally secured in recesses 33, 43 of an appropriate slider joint 30, 40 by a pin (not shown) that passes through holes 35, 45 in respective walls 34, 44 and through the end of the cross member 22.

As explained above, the slider joints 30, 40 may slide along respective legs 18 so as to move the cross members 22, and hence the collapsible frame structure 12, between the folded arrangement and the fully open arrangement. In this respect, referring to FIG. 2, each slider joint 30, 40 may be configured to slide between a first position P1 on its respective leg 18 corresponding to a folded arrangement of the collapsible frame structure 12, and a second position P2 on its respective leg corresponding to a fully open arrangement of the collapsible frame structure 12. As the slider joints 30, 40 slide along respective legs 18 toward the first and second positions P1, P2, respectively, they cause the cross members 22 to scissor close and open. As the cross members 22 scissor open, they expand the collapsible frame structure 12 substantially.

The legs 18 may have a curved shape, at least between the first and second positions P1, P2 so as to facilitate collapsing the collapsible frame structure 12 into its folded arrangement. The first position P1 and the second position P2 generally correspond to the folded arrangement and the open arrangement, respectively. Alternatively, the legs 18 may be completely straight or have some other shape.

The collapsible frame structure 12 also includes at least one latch mechanism 50. Each latch mechanism 50 is configured to selectively engage at least one of the slider joints 40 with a respective leg 18. FIG. 2 illustrates a configuration with two latch mechanisms 50. Alternatively, the number of latch mechanisms 50 may be one or more than two.

Figure 8:
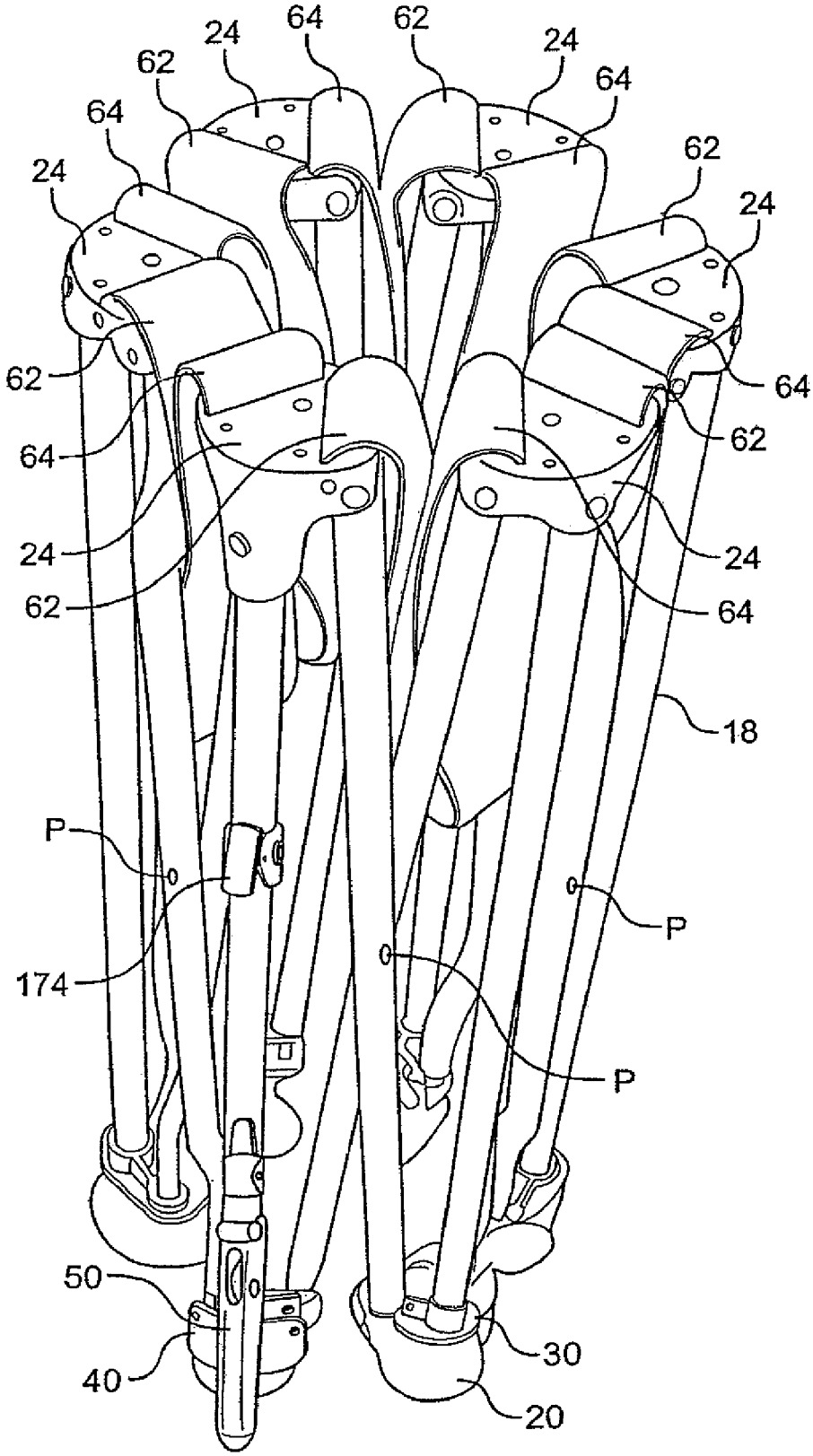
FIG. 8 is a perspective view illustrating a collapsible frame structure in a folded arrangement according to an exemplary embodiment of the present invention.

FIG. 8 illustrates the collapsible frame structure 12 in its folded arrangement. In this arrangement, the cross members 22 are substantially parallel to the legs 18.

The collapsible nature of the collapsible frame structure 12 provides a frame with good portability. The compact fold of the frame structure 12 allows for the frame structure and playard 10 to be readily carried. In the fully open arrangement, the frame structure 12 along with the enclosure 14 provides a large play space.

Figure 9:
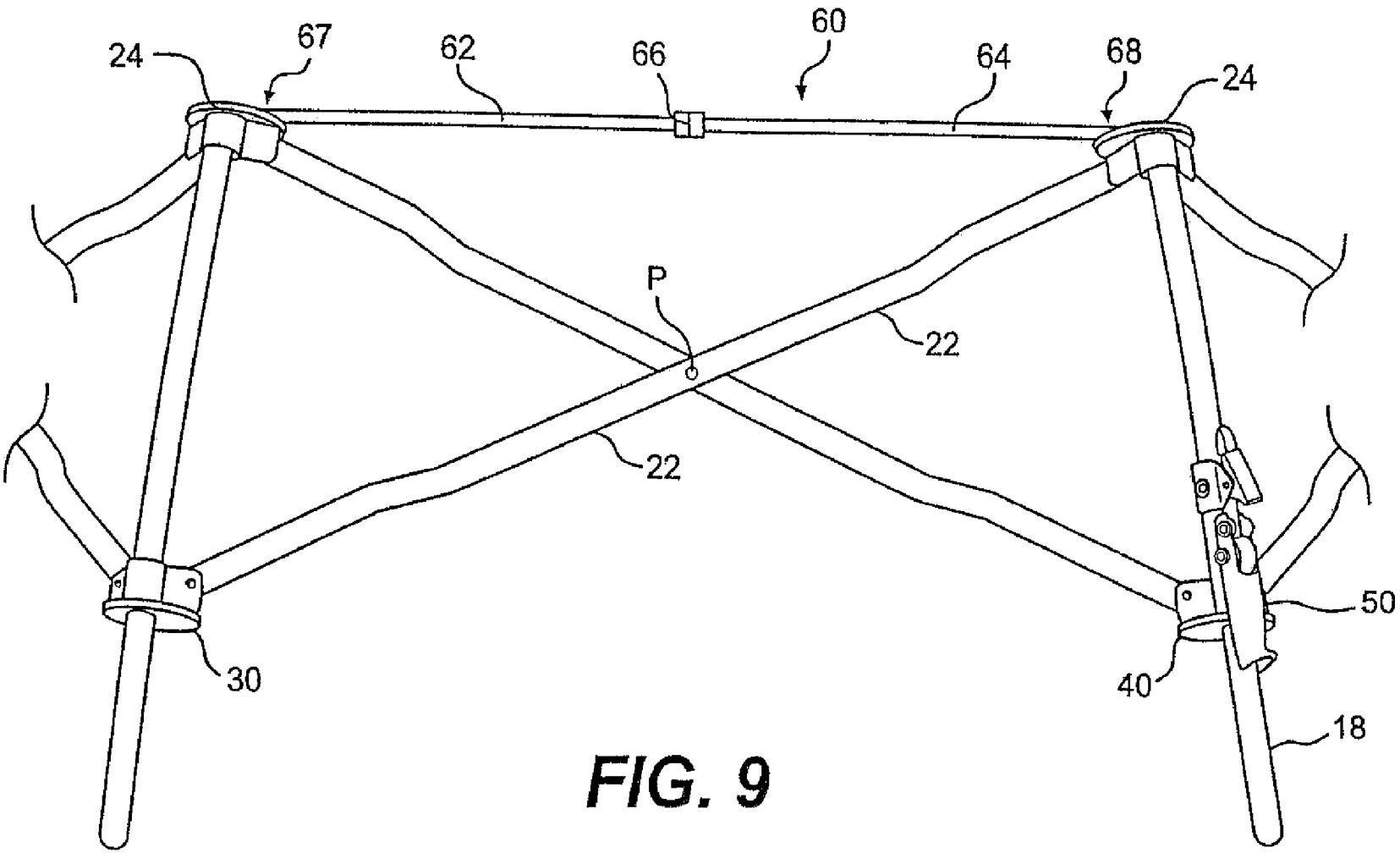
FIG. 9 is a side view illustrating a section of the collapsible frame structure of FIG. 2 with a top rail.

FIG. 9 illustrates a side of the playard 10 with a top rail 60 extending between adjacent legs 18. The playard 10 can include a plurality of top rails 60, each top rail 60 extending between respective adjacent legs 18 and secured to respective pivot joints 24. The top rail 60 provides support for the enclosure 14 when the playard 10 is in the fully open arrangement. When the collapsible frame structure 12 folds to the folded arrangement, each of the top rails 60 folds, allowing the collapsible frame structure 12 to collapse in a compact fashion.

Preferably the top rails 60 are flexible, thus reducing the number of steps required to fold or erect the playard 10. Each top rail 60 may comprise, for example, a strip of fabric material or webbing, which is taut in the open arrangement. Alternatively, each top rail 60 may comprise two stiff sections 62 and 64, respectively, with a fold mechanism 66 intermediate end portions 67 and 68 of the rail 60, separating the two stiff sections 62 and 64, so that the stiff sections may fold when the collapsible frame structure 12 collapses. The fold mechanism may comprise, for example, a hinge, a fold latch, or a simple pivot assembly. Examples of appropriate fold latches are disclosed in, for example, U.S. patent application Ser. No. 09/969,498 entitled "TOP RAIL LATCH FOR FOLDING PLAYARD" filed on Oct. 3, 2001, now abandoned, and published on Apr. 3, 2003 as PG publication No. U.S. 2003/0061658 A1, which is hereby incorporated by reference.

FIG. 17 shows how the top rail 60 can be secured to a pivot joint 24. In this regard, each of the walls 26 of the pivot joint 24 can include an opening 28 into which a pin 29 can be seated. The pin 29 is aligned with slot S that extends through the upper surface of the joint 24. To secure the top rail to the joint 24, the end of the top rail 60 can be threaded through the appropriate slot S and wrapped around the pin 29 and then sewn or otherwise attached to the remainder of the top rail 60, as shown in FIG. 17. Other methods of securing the top rail to a joint 24 also are contemplated by this invention. For example, rather than having a single slot S allocated to receive the end of the top rail 60, the joint 24 can have two parallel slots so that the end of the top rail 60 can be threaded from the upper surface down through the first slot, back up through the second slot, and then secured to the remainder of the top rail 60.

Folding and unfolding the frame structure 12 is now explained with respect to FIGS. 2 and 8. From the open arrangement, a user can release the latching mechanisms 50 to allow the slider joints 40 to freely slide up and down the legs 18. The user than exerts a force on the frame 12 to cause the frame 12 to collapse inwardly. As the force is exerted, the slider joints 30 and 40 slide from the second position P2 to the first position P1, causing cross members 22 to scissor closed. The frame structure 12 is now in the folded arrangement of FIG. 8. To open the frame structure 12, a user exerts a force on the frame structure 12 to cause the frame structure 12 to expand outwardly, and the cross members scissor open. The latching mechanisms 50 are then latched.

Figure 10:
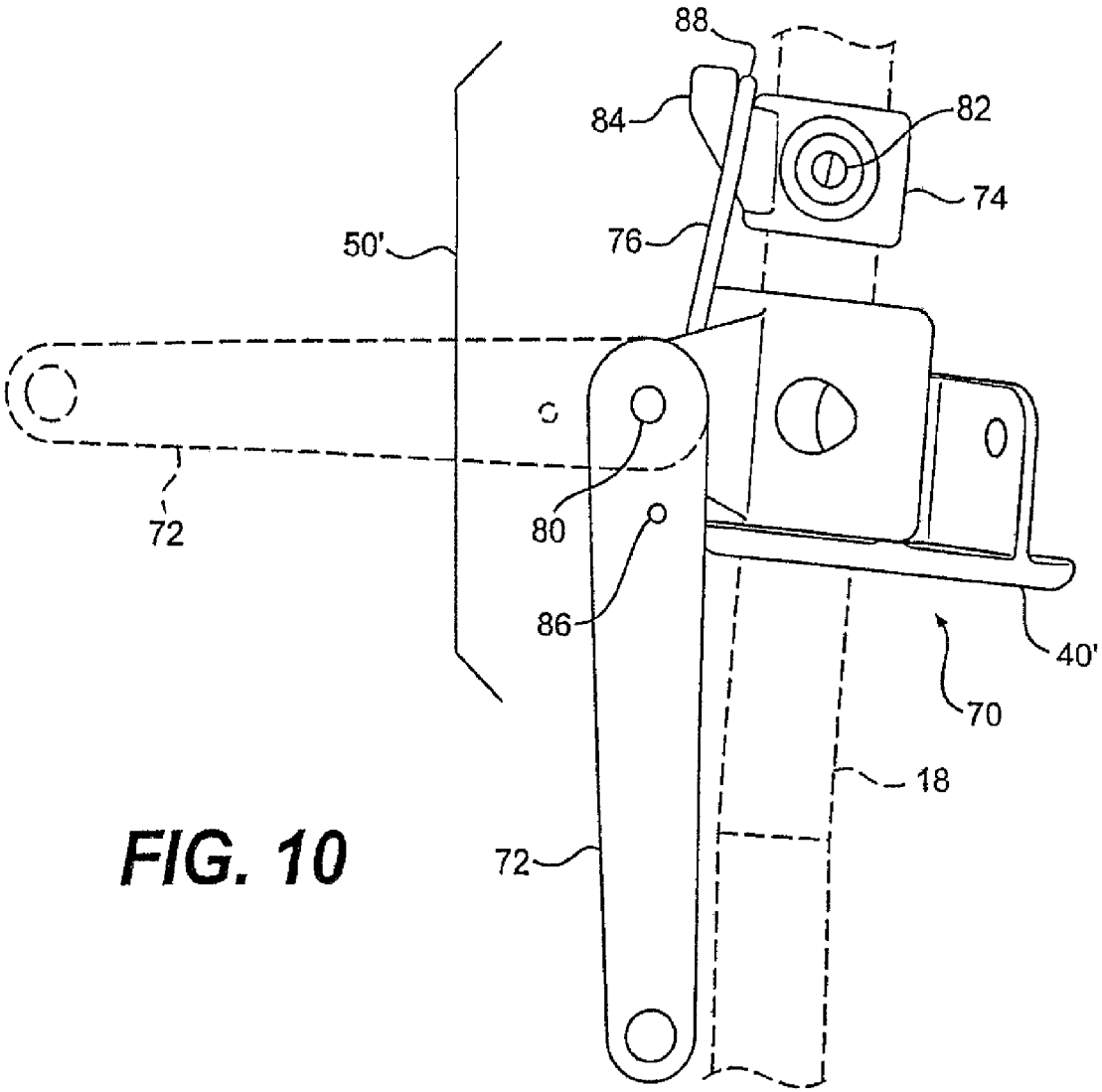
FIG. 10 is a side view illustrating a latch assembly according to an exemplary embodiment of the present invention.

FIG. 10 illustrates one embodiment of a latch assembly 70 for maintaining the playard in an open arrangement. The latch assembly 70 generally includes a slider joint 40' for slidingly engaging a leg 18 of the playard and a latch mechanism 50'. The latch mechanism 50' includes a handle 72, a first latch member 74, and a second latch member 76.

The handle 72 is pivotably attached to the slider joint 40'. In this embodiment of a latch assembly, the handle 72 is attached to the slider joint 40' via a pin 80.

The first latch member 74 is configured to be attached to the leg 18. The first latch member 74 may be fixedly attached to the leg 18 by means of a screw or bolt 82, for example. In this embodiment of the latch assembly, the first latch member 74 is a latch hook and includes a hook portion 84.

The second latch member 76 is attached to the handle 72 and is configured to engage the first latch member 74 to prevent the slider joint 40' from sliding relative to the leg 18. In this embodiment of the latch assembly, the second latch member 76 comprises a bail. The bail 76 is pivotably attached to the handle 72 via a contact portion 86 of the second latch member, where the contact portion 86 extends into the latch handle. A loop portion 88 of the bail 76 can extend over the hook portion 84 of the first latch member 74 to prevent the slider joint 40' from sliding relative to the leg 18.

FIG. 10 illustrates the handle in a first handle position in solid line, where the handle 72 extends in a direction along the leg 18. In the first handle position, the bail 76 engages the hook portion 84. When the handle 72 is in the second handle position, shown in dashed line, the handle 72 extends in a direction other than along the leg 18. In the second handle position, the bail 76 can be engaged or disengaged with the first latch mechanism. That is, in the second handle position, the bail 76 can be rotated about the contact portion 86 to pass over the hook portion 84.

FIGS. 11-14 illustrate a second embodiment of a latch assembly 170 for maintaining the playard in an open arrangement. The latch assembly 170 generally includes a slider joint 40 for slidingly engaging a leg 18 of the playard and a latch mechanism 50. The latch mechanism 50 of this second embodiment of a latch assembly includes a handle 172, a first latch member 174, and a second latch member 176.

The handle 172 is pivotably attached to the slider joint 40. In this embodiment of the latch assembly, the handle 172 is attached to the slider joint 40 via a pin 180.

The first latch member 174 is configured to be attached to the leg 18. In this embodiment of the latch assembly, the first latch member 174 comprises a toggle mount 182 and a toggle 184. The toggle mount 182 may be fixedly attached to the leg 18 by means of a screw or bolt 186, for example. The toggle 184 is pivotably attached to the toggle mount 182, for example, by a pin 188.

Figure 14:
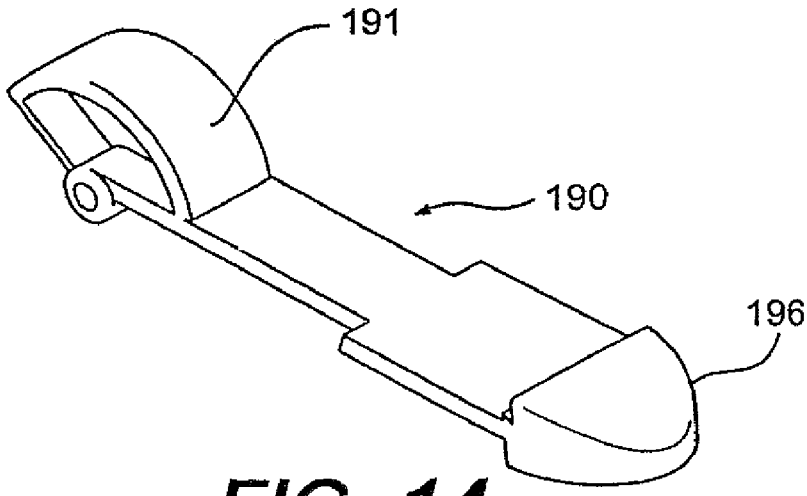
FIG. 14 is a perspective view illustrating a toggle engagement member of the latch assembly according to the exemplary embodiment of FIG. 11.
Figure 13:
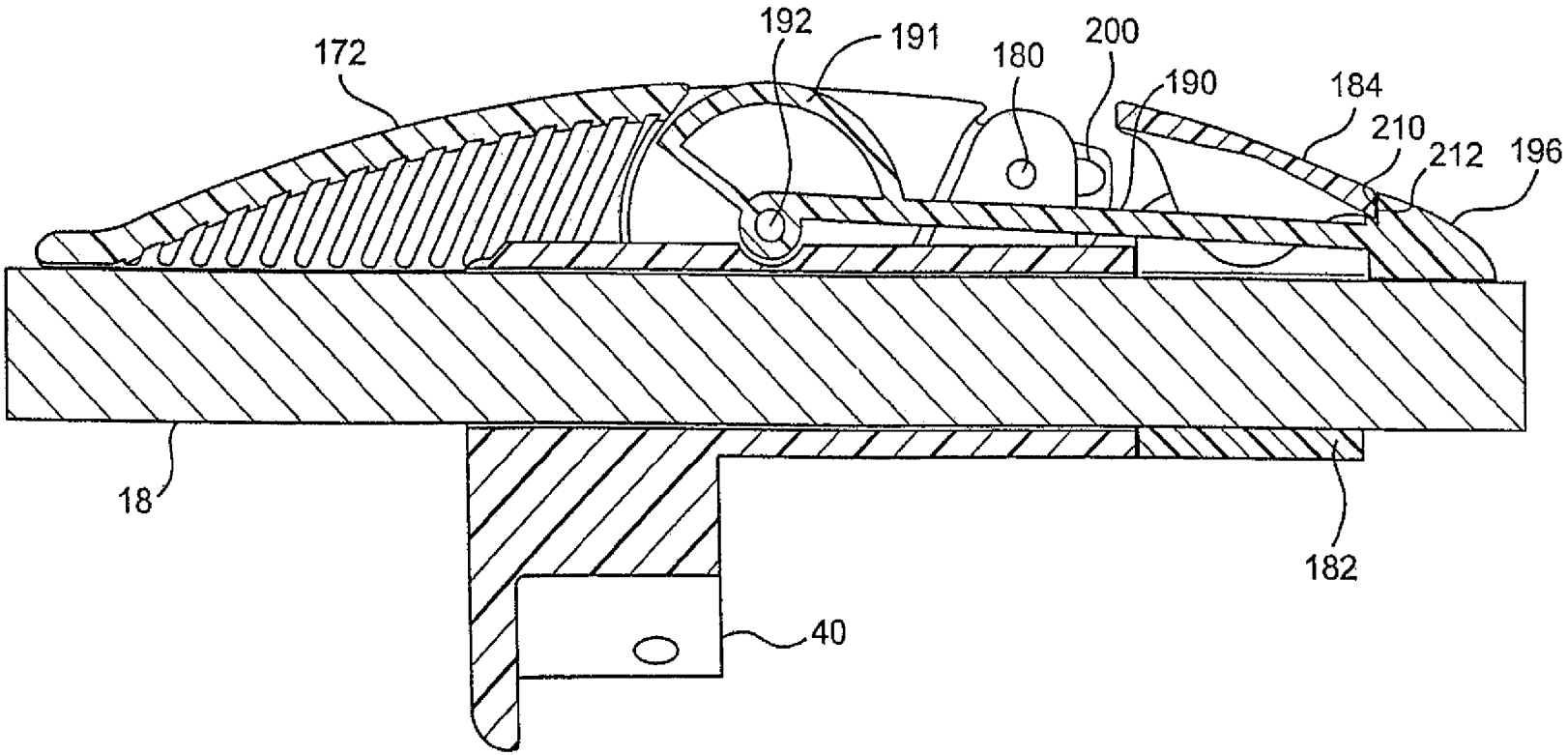
FIG. 13 is a cutaway side view, in partial cross section, illustrating a latch assembly according to the exemplary embodiment of FIG. 11.

The second latch member 176 is attached to the handle 172 and configured to engage the first latch member 174 to prevent the slider joint 40 from sliding relative to the leg 18. In this embodiment, the second latch member 176 comprises a toggle engagement member. The toggle engagement member 176 is pivotably attached to the handle 172 via a pin 192 that extends into the latch handle 172. As shown in FIG. 14, the toggle engagement member 176 includes an arcuate section 191 where the pin 192 is along an axis about which the arcuate section 191 can rotate. The toggle engagement member 176 is configured to slide beyond the toggle 184 to engage the toggle 184 to prevent the slider joint 40 from sliding relative to the leg 18, as shown in FIG. 13. When the toggle engagement member 176 engages the toggle 184, an edge surface 210 of the toggle 184 engages an edge surface 212 of the toggle engagement clip 196.

Figure 12:
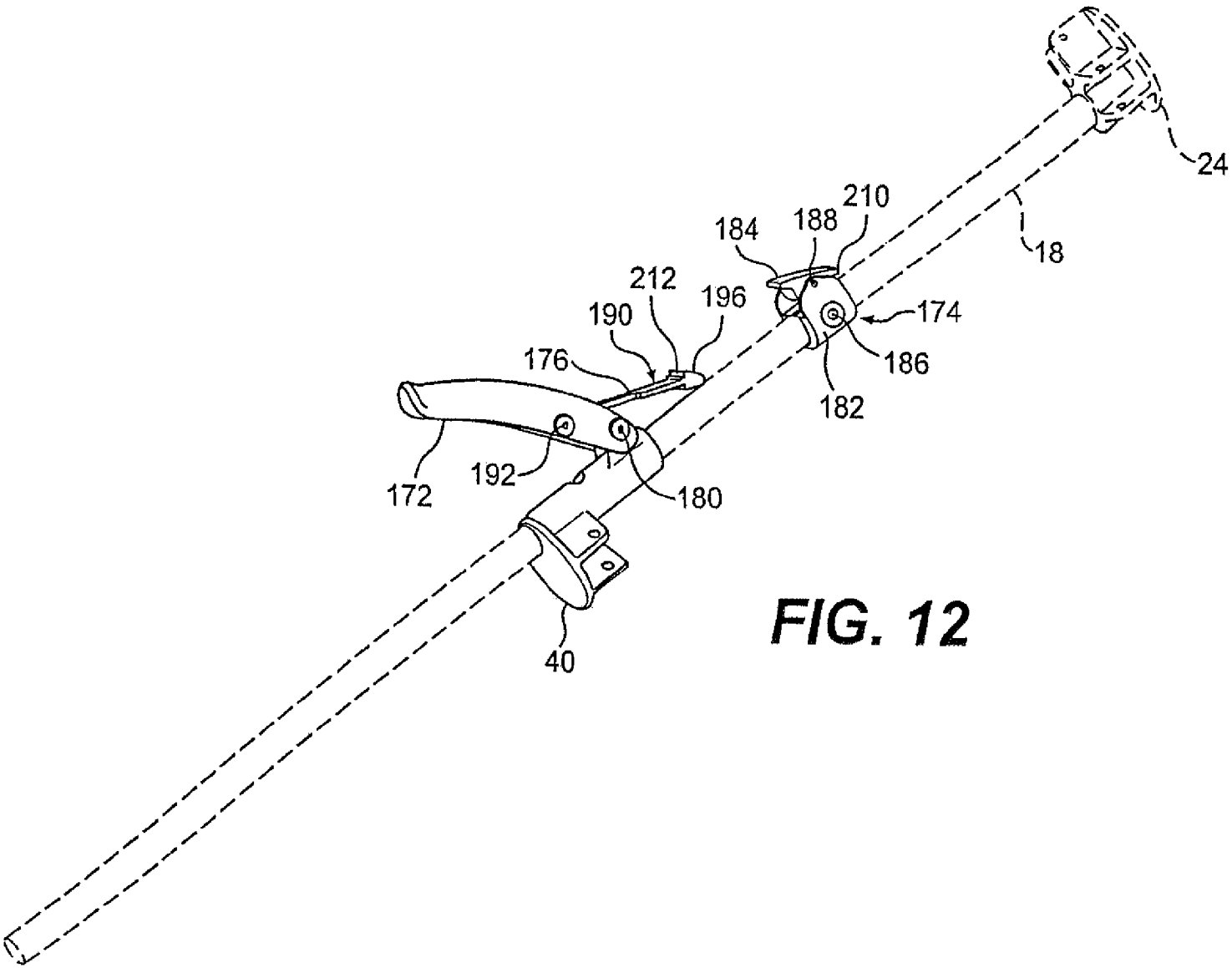
FIG. 12 is a perspective view illustrating a latch assembly according to the exemplary embodiment of FIG. 11 with the handle in a second handle position.

FIG. 12 illustrates the handle in a second handle position, wherein the handle 172 extends in a direction other than along the leg 18. In the second handle position, the toggle engagement member 176 can move past the toggle 184 by sliding a toggle engagement clip 196 of the toggle engagement member 176 between the toggle 184 and the leg 18. In this regard, the toggle 184 may be in a first toggle position or other positions as the toggle engagement clip 196 slides past a range of positions. Once the toggle engagement clip 196 slides past the toggle 184, the toggle 184 pivots to a second toggle position to engage the clip 196. In this regard, the toggle 184 may be spring biased to bias the toggle 184 towards the second toggle position shown in FIG. 12.

Figure 11:
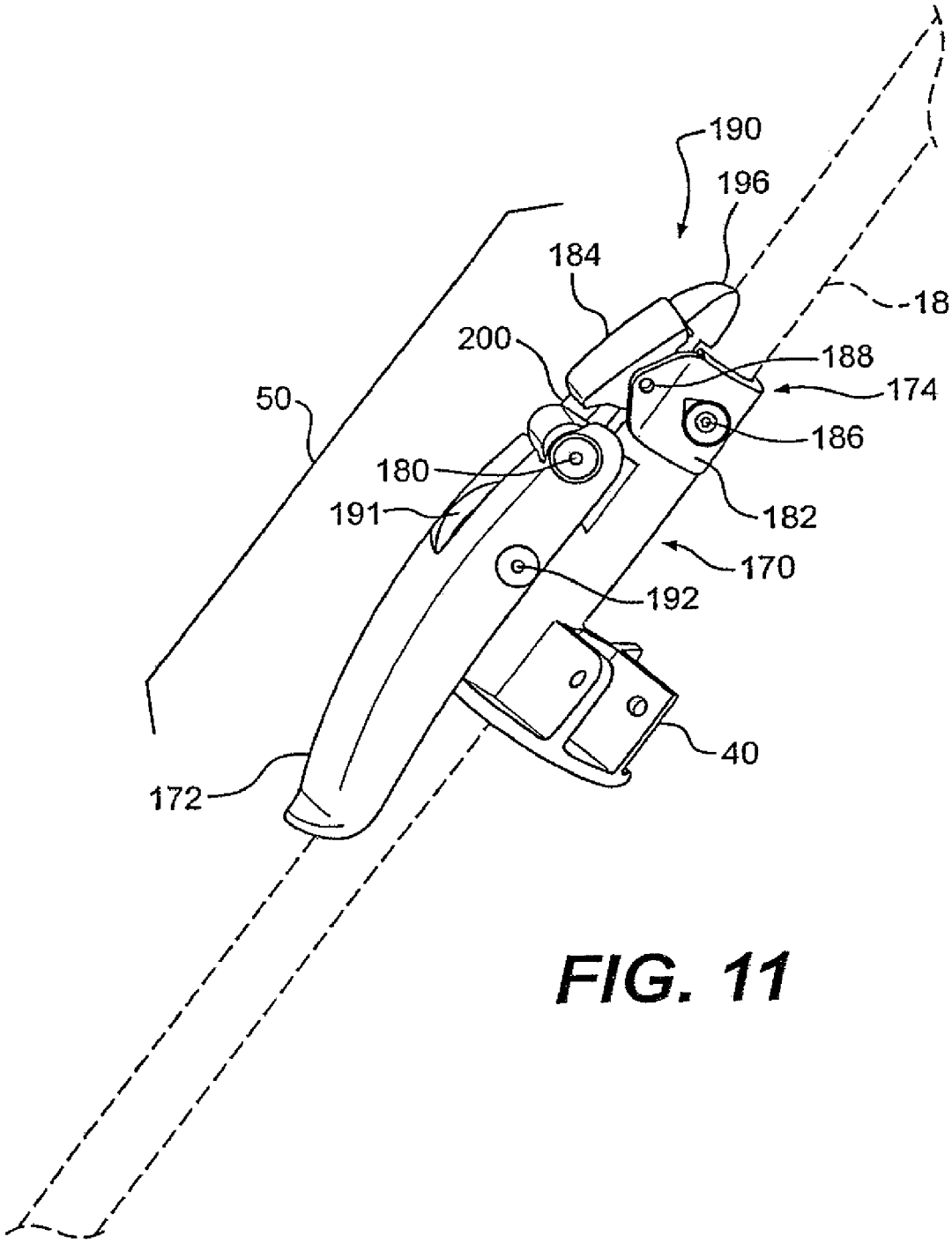
FIG. 11 is a perspective view illustrating a latch assembly according to another exemplary embodiment of the present invention with the handle in a first handle position.

In the first handle position shown in FIGS. 11 and 13, the handle 172 extends in a direction along the leg 18. When the handle 172 is in this position, the toggle engagement member 176 remains engaged with the toggle 184. In this regard, the handle includes at least one protrusion, or nub, 200 which prevents toggle 184 from rotating to the first toggle position to disengage the toggle engagement clip 196, absent movement of handle.

Figure 15:
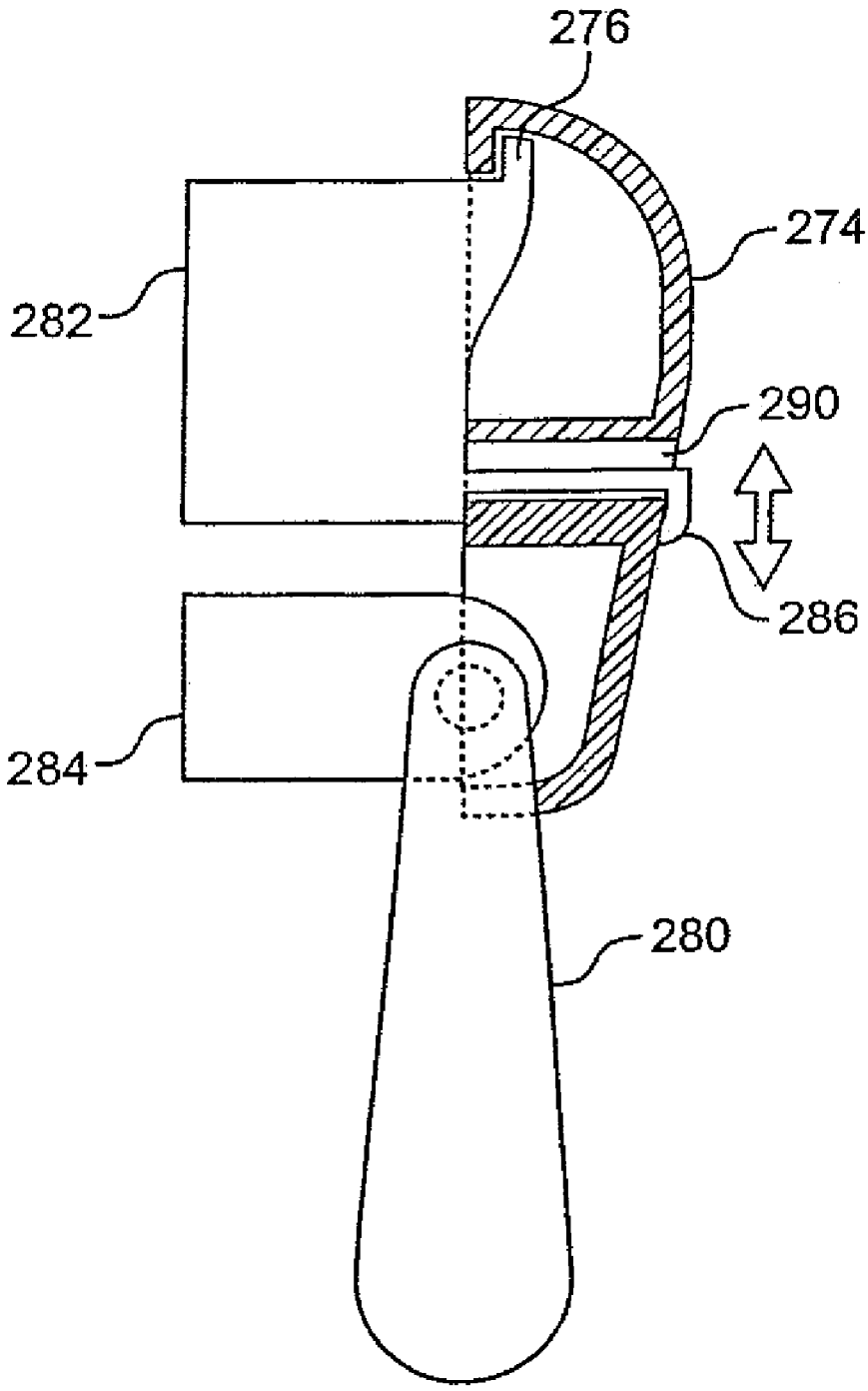
FIG. 15 is a side view, in partial cross-section, illustrating a latch assembly according to an exemplary embodiment of the present invention.
Figure 16:
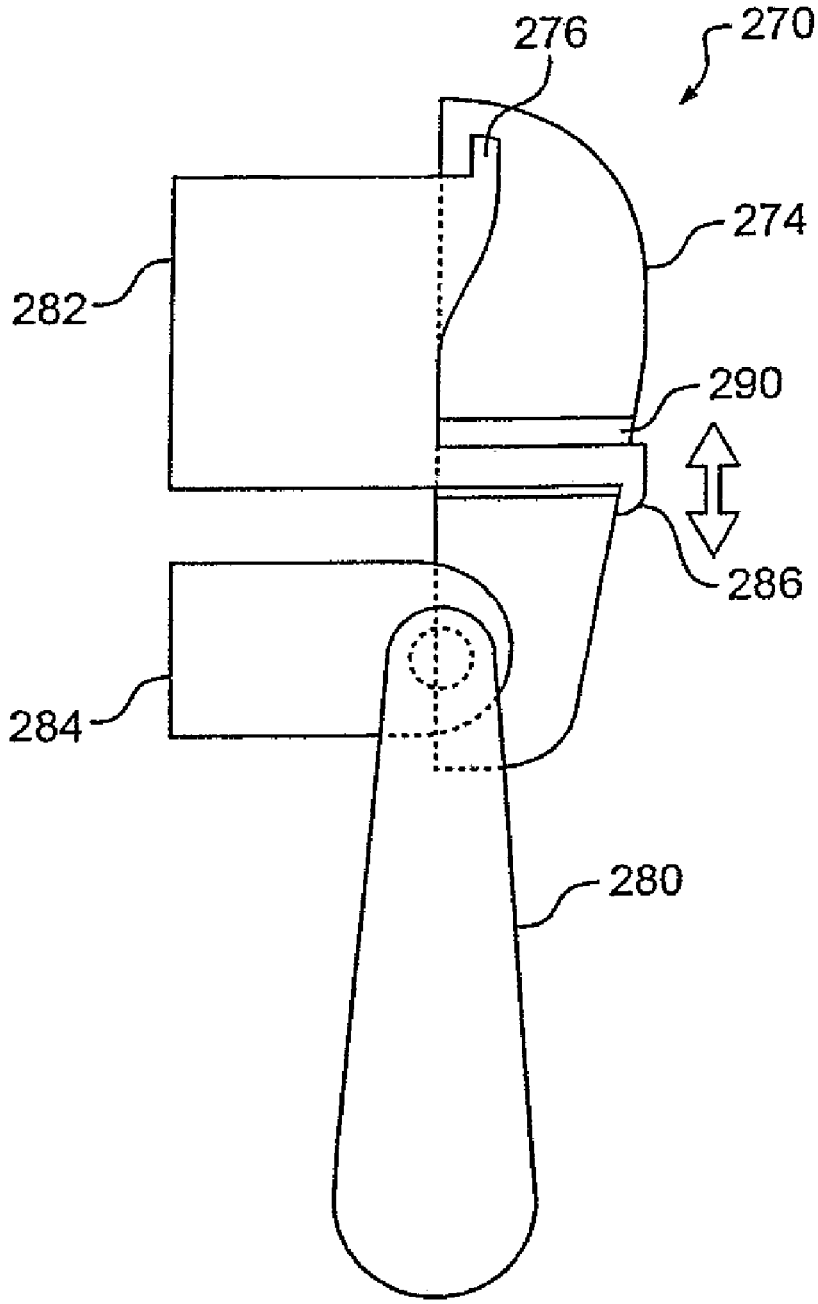
FIG. 16 is a side view illustrating a latch assembly according to the exemplary embodiment of FIG. 15.

FIGS. 15 and 16 are side views, with FIG. 15 in partial cross-section, illustrating a latch assembly 270 according to another exemplary embodiment of the present invention. This latch assembly 270 provides a secondary lock. The latch assembly 270 includes a latch member 282, a hook 276, and a spring finger 286. The latch member 282 may be fixed relative to a leg of the frame structure. The latch assembly 270 also includes a bail 274 attached to slider joint 284, and a handle 280 pivotably mounted to the slider joint 284. Slider joint 284 can be configured like slider joint 40 of FIG. 10. FIGS. 15 and 16 illustrate the handle 280 in a position such that the bail 274 is looped over the hook 276 to engage the hook 276. The spring finger 286 passes through a hole 290 in the bail 274 to contact and engage an outside surface of a lower portion of the bail 274. The engagement of the hook 276 and bail 274 provide a first lock, and the engagement of the snap finger 286 and the bail 274 provide a second lock. In FIG. 16, the upward arrow indicates the motion that a thumb or finger would take in pushing up the spring finger 286 to release the finger 286 from the bail 274, so that the bail 274 may be disengaged from the hook 276 using the handle 280.

Figure 3:
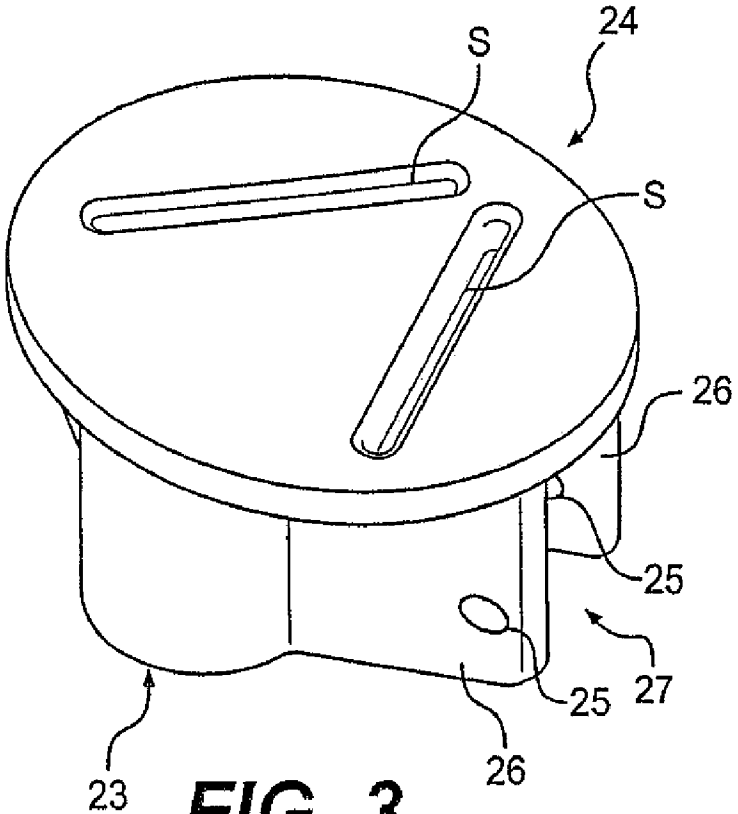
FIG. 3 is a perspective view illustrating a pivot joint of the collapsible frame structure of FIG. 2.
Figure 18:
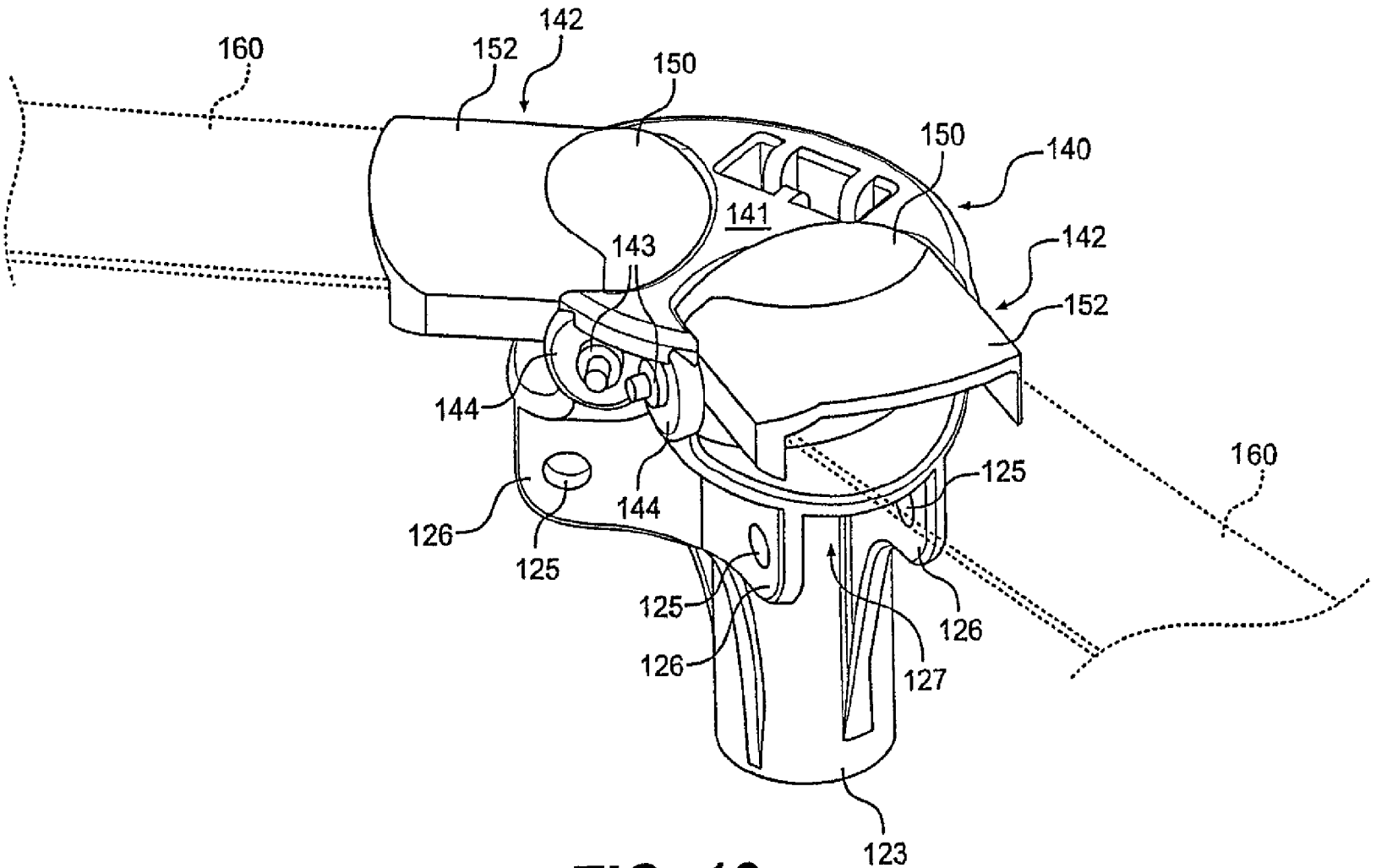
FIG. 18 is a top perspective view of an alternative pivot joint suitable for use with the present invention.
Figure 19:
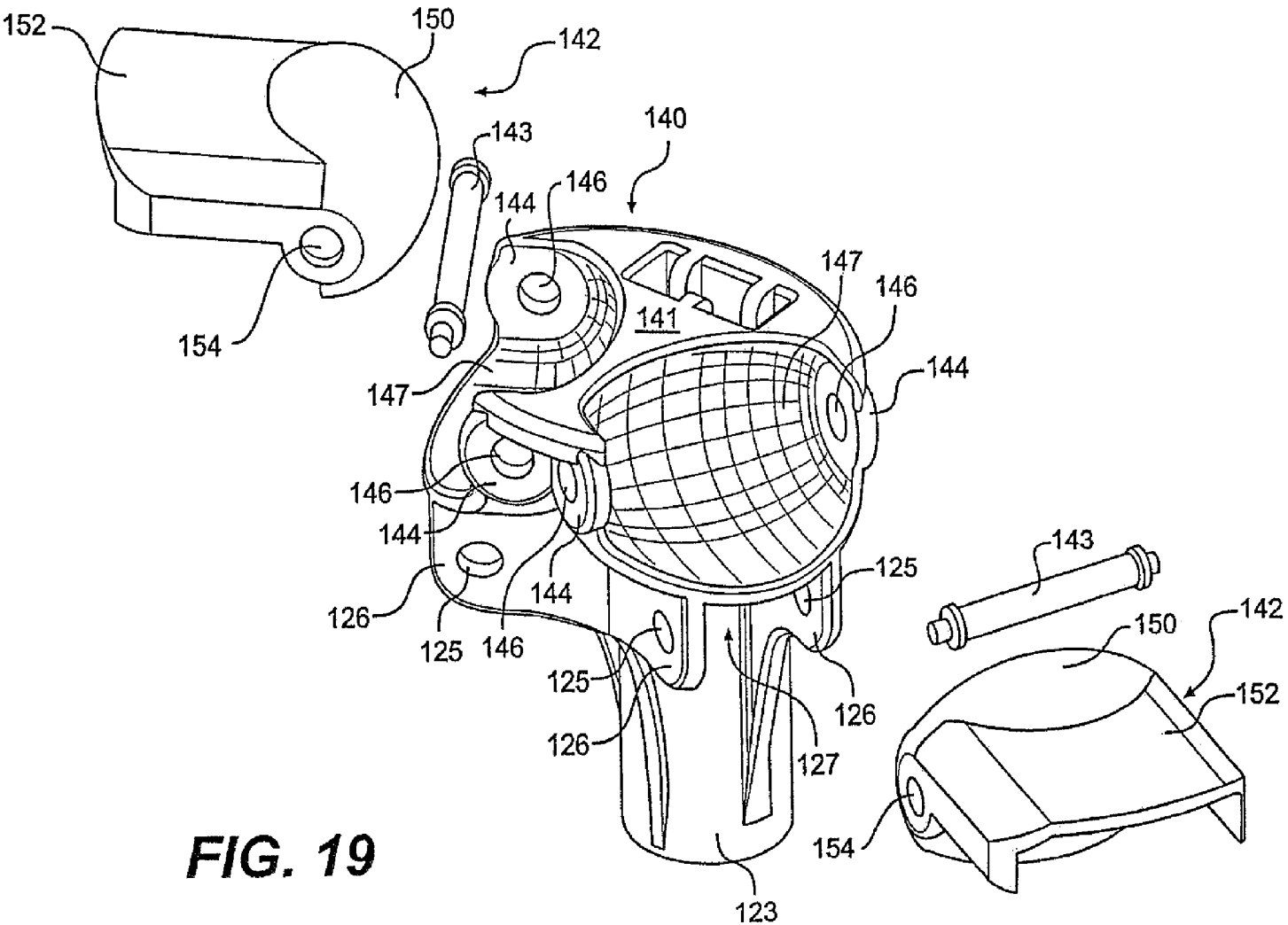
FIG. 19 is an exploded view of the pivot joint of FIG. 18.

FIGS. 18-19 illustrate an alternative pivot joint 140 to the pivot joint 24 shown in FIGS. 3, 4, and 17. The pivot joint 140 is arranged on an upper end of a respective leg 18. In this regard, the leg 18 can fit into a recess in a stem 123 of the pivot joint 124. At least one, and preferably two, cross members 22 also are attached to the pivot joint 140. That is, the pivot joint 140 has walls 126, and an end of a cross member 22 can be positioned within a recess 127 defined by adjacent walls 126. The end of a cross member 22 can be pivotally secured in the respective recess 127 by a pin (not shown) that passes through holes 125 in walls 126 and through the end of the cross member 22.

In a playard employing pivot joints 140, each top rail 60 can include top rail webbing 160 and top rail extensions 142 at either end of the webbing 160. FIG. 18 shows a pair of top rail extensions 142 associated with adjacent top rails 60 that are pivotally connected to the pivot joint 140 by a pair of pivots, such as pins 143. In this regard, the pivot joint 140 also includes extension-receiving areas 147, each bounded by a pair of opposed mounts 144. The mounts 144 each have a hole 146 for receipt of the respective pin 143. The top rail extensions 142 in turn each have a head portion 150 that fits within a respective extension-receiving area 147 of the pivot joint 140. The head portion 150 of each extension 142 includes a pair of holes 154 that align with the holes 146 of the mounts 144 to receive the pin 143. The head portion 150 of the extension 142 can be curved, and the extension-receiving area 147 can be concave to correspond snugly with the curve of the head portion 150.

The top rail extensions 142 also include a flange 152. When the playard 10 is in the fully open arrangement, the flange 152 extends from a surface of the head portion 150 in a direction generally corresponding to the respective top rail 60, as shown in FIG. 18. The top rail webbing 160 can be secured to pin 143 or to the top rail extension 142. For example, an end of the top rail webbing 160 can be looped around pin 143 and then sewn, or otherwise secured, to a remainder of the webbing 160. Alternatively, the head portion 150 can include a hollow shaft (not shown) that extends between holes 154 to receive pin 143, and an end of the top rail webbing 160 can be looped around the shaft and then sewn, or otherwise secured, to a remainder of the webbing 160. In another arrangement, the end of the top rail webbing 160 can be sewn or otherwise secured directly to the head portion 150 or to the flange 152 of the extension 142. For example, the flange 152 can include a slot (not shown) therethrough that extends from its upper surface to its lower surface, and an end of the top rail webbing 160 can be threaded through and wound around the slot and sewn to a remainder of the webbing 160. In this manner, the top rail webbing 160 can be secured directly to the flange 152 of the top rail extension 142.

Figure 20:
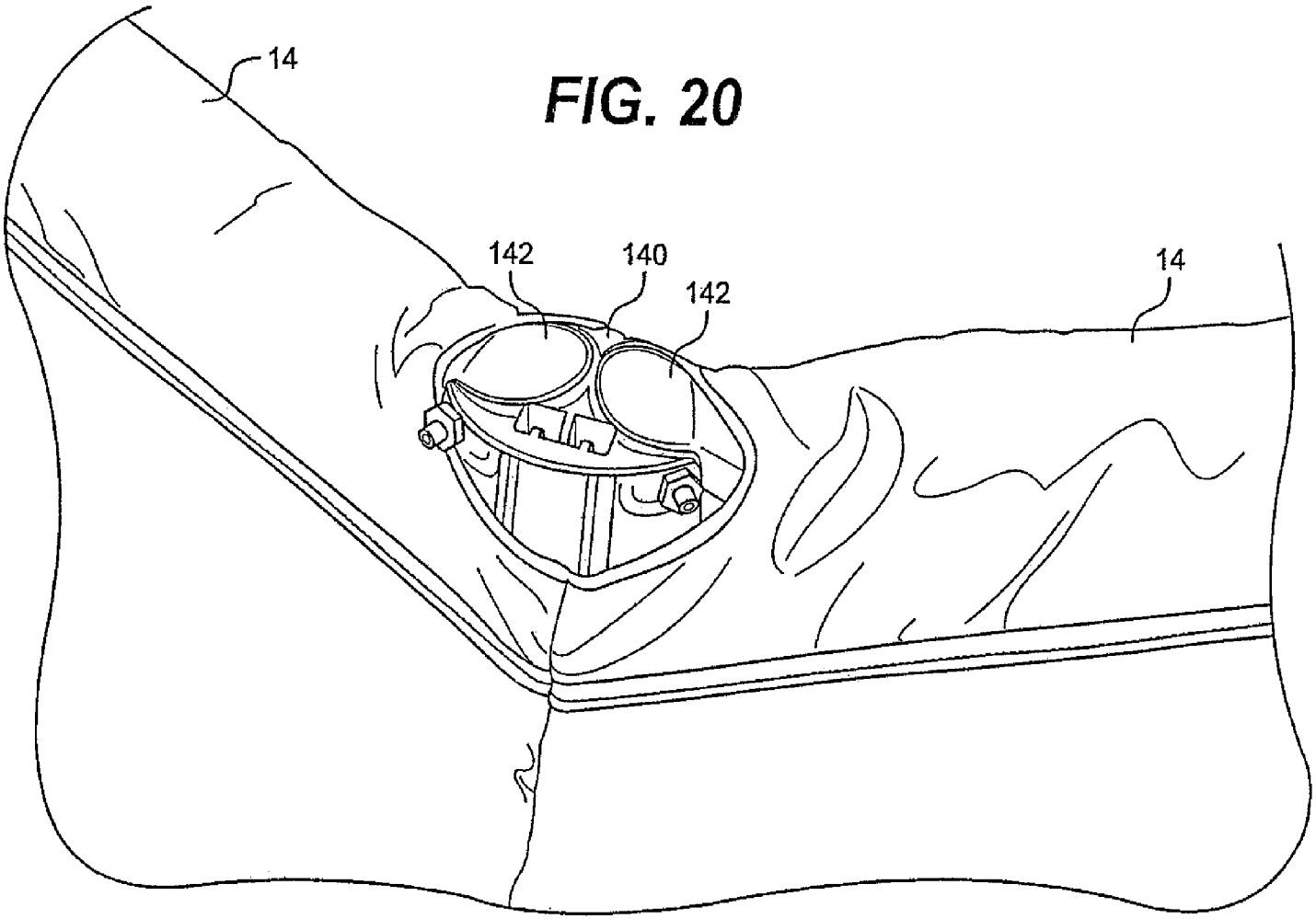
FIG. 20 is a top perspective view of the pivot joint area of a playard, where the playard includes the pivot joint of claim 18.

FIG. 20 shows the pivot joint area of a playard 10 that employs a pivot joint 140. In this embodiment, pivot joint 140 is exposed. In other embodiments, such as the embodiment of FIG. 1, the pivot joint can be covered by the fabric enclosure 14.

In addition, FIG. 20 shows the fabric enclosure 14 supported by the top rail webbing 160, which is hidden by the enclosure 14 in this figure, and at least partially supported by the top rail extensions 142. In this regard, when the playard 10 is in the fully open arrangement, the fabric enclosure 14 is partially supported by the flanges 152 of the extensions 142. When the playard 10 is collapsed to the folded arrangement, the top rail extensions 142 can pivot downward, toward the feet 20 of the playard 10, essentially together with the top rail webbing 161. When the extensions 142 are pivoted downward, the fabric enclosure 14 remains in contact with, and partially supported on, the flanges 152 of the extensions 142, and, consequently, the hole in the fabric enclosure 14 around the pivot joint 140 remains centered relative to the pivot joint 140. Thus, shifting of the fabric enclosure 14 along the top rails 60 and over the pivot joint 140 is prevented.

Figure 21:
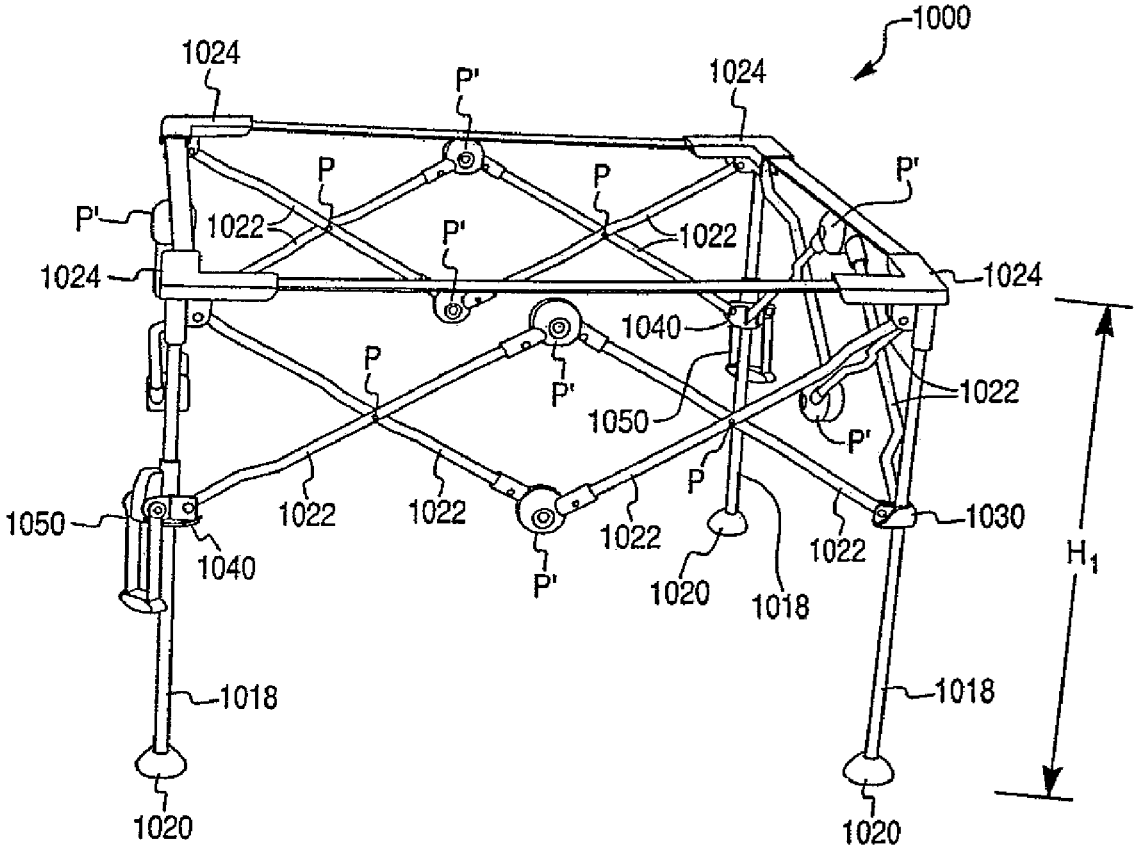
FIG. 21 is a perspective view illustrating a collapsible frame structure in an open arrangement according to an exemplary embodiment of the present invention.
Figure 22:
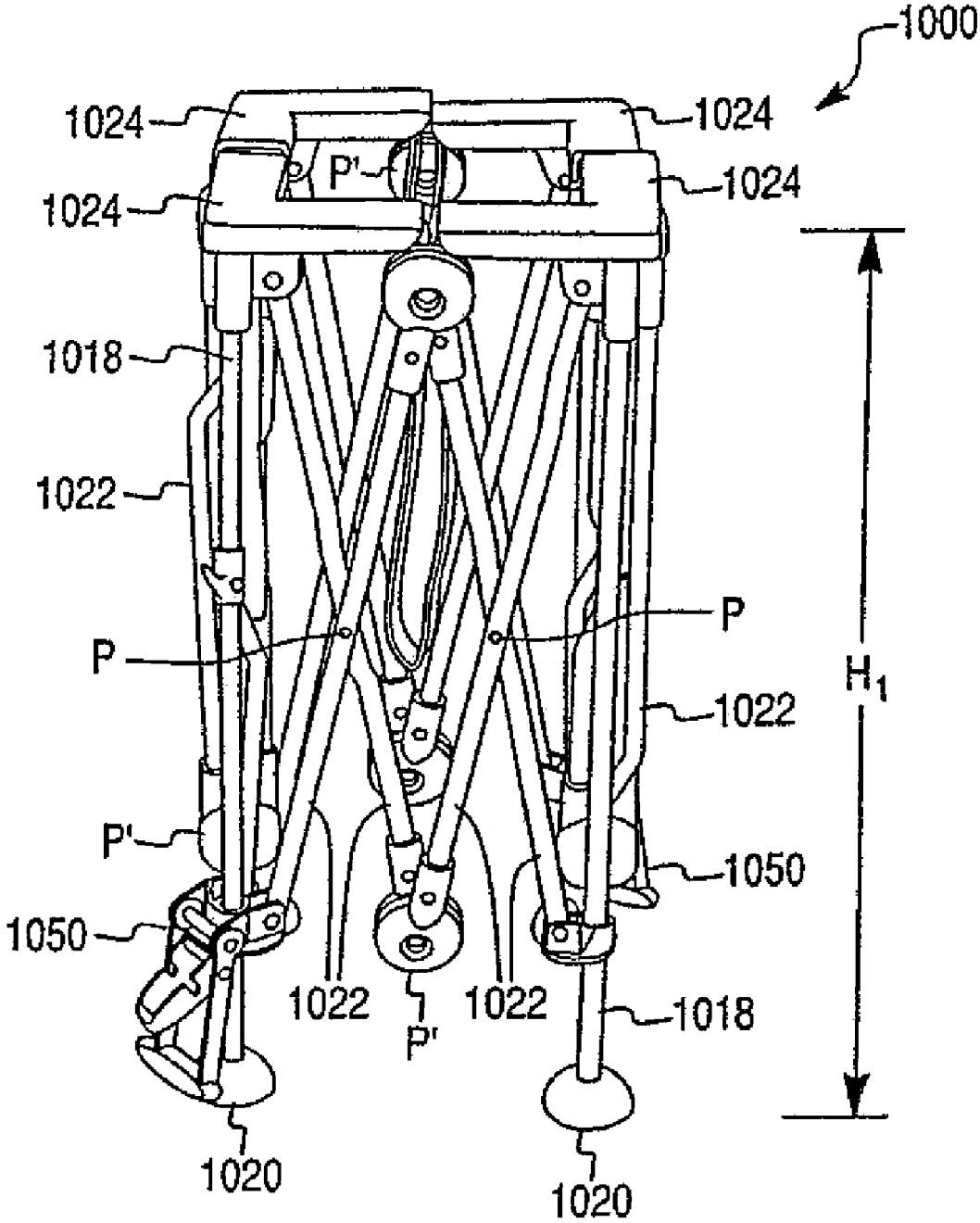
FIG. 22 is a perspective view illustrating the collapsible frame structure of FIG. 21 in a folded arrangement.

FIGS. 21 and 22 illustrate a collapsible frame structure 1000 in an open and folded arrangement, respectively, according to another embodiment. The collapsible frame 1000 may be used as a support for a fabric enclosure of a playard, for example. The collapsible frame structure 1000 includes a plurality of legs 1018, cross members 1022 arranged between the legs 1018, and pivot joints 1024, 1030, and 1040 pivotably connected to respective cross members 1018.

The cross members 1022 may be arranged in pairs, for example, in a similar fashion to the cross members 22 of the embodiment illustrated in FIG. 2, where the cross members 1022 can pivot relative to each other about pivots P. The pairs of cross members 1022 may be arranged in an X-shape, for example.

The cross members 1022 define interconnected sides of the collapsible frame structure 1000. The frame structure has at least three interconnected sides, where each of the sides includes at least one pair of the cross members 1022. For example, the frame structure 1000 shown in FIGS. 21 and 22 has four sides.

Each of the interconnected sides has at least one pair of cross members 1022, but may have multiple pairs of cross members 1022 arranged in a serial fashion, for example. FIGS. 21 and 22 illustrate a frame structure 1000 with one pair of opposing sides, each having a single pair of cross-members 1022, and another pair of opposing sides, each having two pairs of cross members 1022. For the sides with two pairs of cross members 1022, the cross-members 1022 are arranged serially in pairs in a double-X shape. In this case each of the cross members 1022 is pivotably connected to another cross-member of an adjacent pair at one end of the cross member at a pivot P'.

Figure 23:
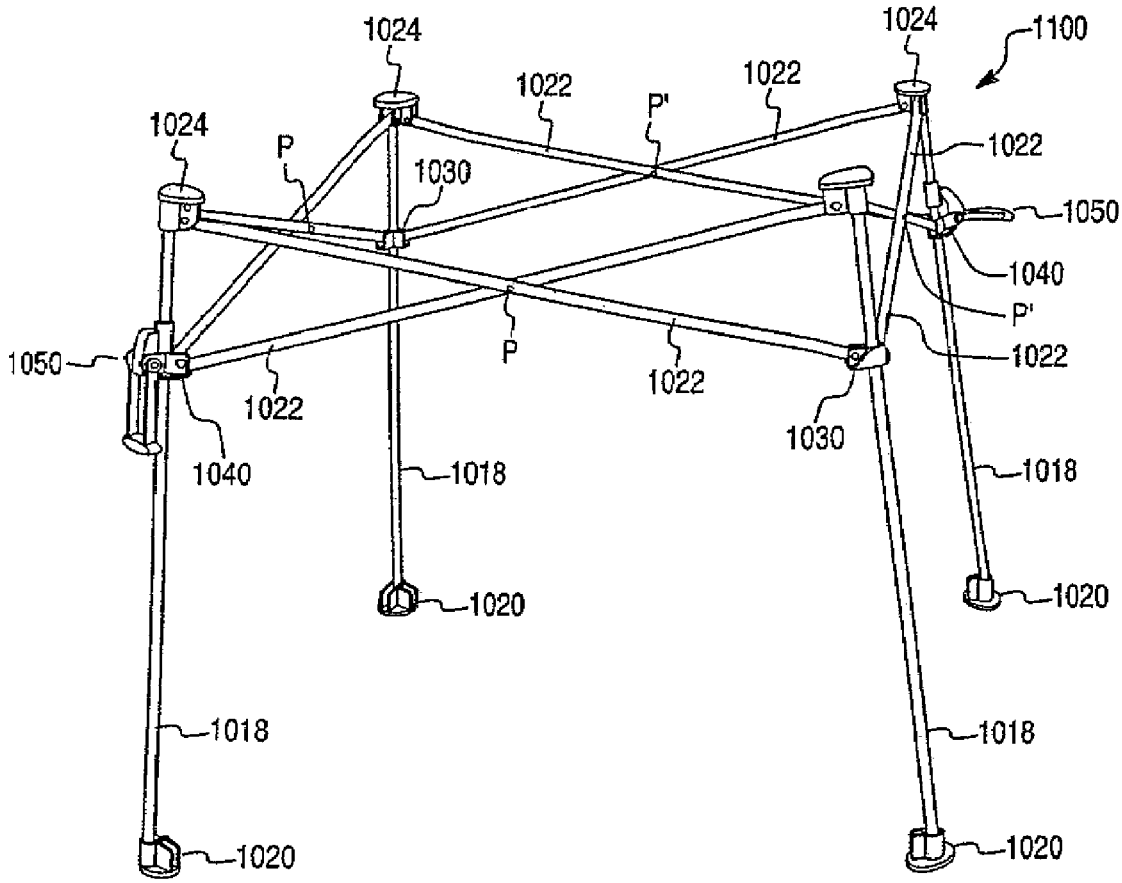
FIG. 23 is a perspective view illustrating a collapsible frame structure in an open arrangement to compare to the collapsible frame structure of FIG. 21.

The frame structure described above with sides having multiple pairs of cross members allows for a shorter height in the folded arrangement of the frame structure. In other words, for two frames with the same side length in the open arrangement, the height is shorter for a frame structure where the sides have multiple pairs of cross members as compared to a frame structure where each side has only a single pair of cross-members. This advantage is illustrated by a comparison of the frame structure 1000 illustrated in FIGS. 21 and 22, which has multiple pairs of cross members 1022 arranged serially on each side, with the frame structure of FIGS. 23 and 24, which has a frame structure 1100 with a single pair of cross members 1022 on each side. As can be seen by comparing FIGS. 22 and 24, the height HI of the frame structure 1000 in the folded arrangement is less than the height H2 of the frame structure 1100 in the folded arrangement, while the length of the sides of the two frame structures are the same in the open arrangement. Thus, the possibility of a frame structure with sides having multiple cross members allows for a more compact fold for the frame structure.

Moreover, the frame structure may have some sides with a first number of pairs of cross members, while other sides have a second number of pairs different from the first number. In this way, a frame structure with sides of differing lengths may be readily achieved. In general, the ratio of the length of a particular side of the frame structure to another side of the frame structure will be approximately equal to the ratio of number of pairs of cross members of those sides. For example, if one side has three pairs of cross members arranged in a serial fashion, while another side has a single pair, the ratio of the length of the one side to the other side will be approximately 3/1. Thus, a flexibility in the shape of the frame structure is achieved by allowing for sides of the frame structure to have different numbers of cross members.

Further, as can be seen by a comparison of FIGS. 21 and 22, the frame structure 1000 may be such that the height of the frame structure 1000 in the folded arrangement is substantially the same as the height in the open arrangement. As can be seen in FIGS. 21 and 22, the height in both the folded and open arrangement is H1. Alternatively, the height of the of the frame structure 1000 in the folded arrangement may be less than or equal to the height in the open arrangement. The shorter height allows a user to more easily place an infant into and remove the infant from the frame structure.

Figure 28:
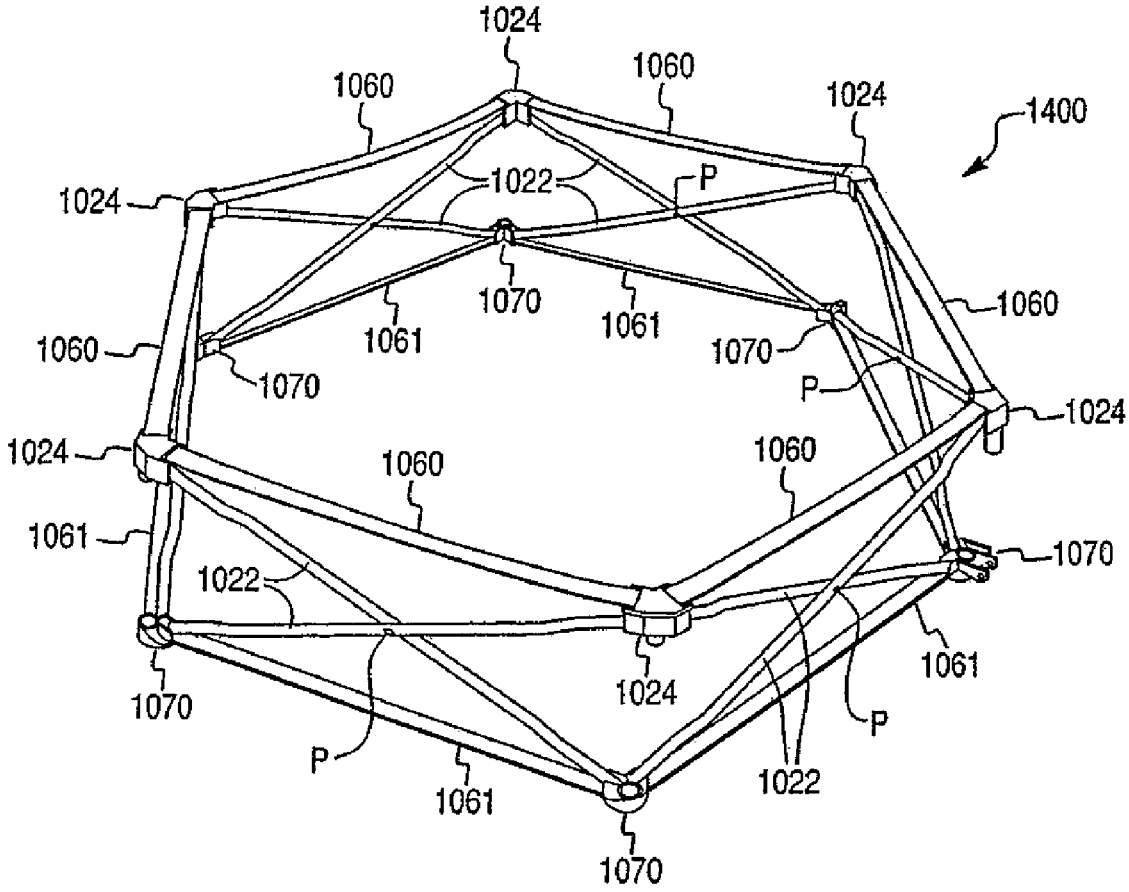
FIG. 28 is a perspective view illustrating a collapsible frame structure in an open arrangement according to another exemplary embodiment of the present invention.

In addition, referring to FIGS. 2 and 28, the collapsible frame structure in accordance with this invention does not require a center hub, such as the hub shown in U.S. Pat. No. 5,697,111, to interconnect the legs and/or sides of the frame structure. The interior of the collapsible frame structure, defined by the sides of the frame structure, can be free of frame joints, such as a center hub. The embodiments of FIGS. 2 and 28, for example, illustrate collapsible frame structures having interiors that are free of frame joints. The pivot joints and the slider joints of these embodiments are associated with the legs of the frame structure; these joints are not located in an interior of the collapsible frame structure. Further, nonadjacent legs and nonadjacent sides of the collapsible frame structure can remain unconnected across an interior of the collapsible frame structure, for example as shown in FIGS. 2 and 28. It will be understood that, in certain embodiments, portions or all of some frame components can extend into the interior of the collapsible frame structure.

The frame structure 1000 shown in FIGS. 21 and 22 has four legs 1018 and six pairs of cross members 1022. In general the number of legs 1018 may be other than four, and the number of pair of cross members 1022 may be other than six.

Each of the legs 1018 may be similar to the legs 18 described with respect to the frame structure 10 of FIG. 1, described above. The frame structure 1000 may also include a number of feet 1020 similar to the feet 20 described above with respect to FIG. 2, for example.

The pivot joints 1024 may be similar to the pivot joints 24 described above with respect to FIGS. 24 and 17 or pivot joints 140 described above with respect to FIGS. 18-20, for example.

The pivot joints 1030 and 1040 may be similar to the slider joints 30 and 40, respectively, described above with respect to FIGS. 2 and 5-7. In this respect, the pivot joints 1030 and 1040 may function not only to be pivotably connected to respective cross members 1022, but also to slidingly engage a respective one of the legs 1018.

The frame structure 1000 may also include one or more latch mechanisms 1050 configured to selectively engage at least one of the pivot joints 1040. The latch mechanism 1050 may be similar to the latch mechanism 50 or the latch mechanism 50' described above with respect to FIGS. 9-13, for example. Other suitable latch mechanisms are described in U.S. application Ser. No. 10/995,521, entitled "Playard," and filed Nov. 24, 2004, the disclosure of which is incorporated by reference.

Figure 25:
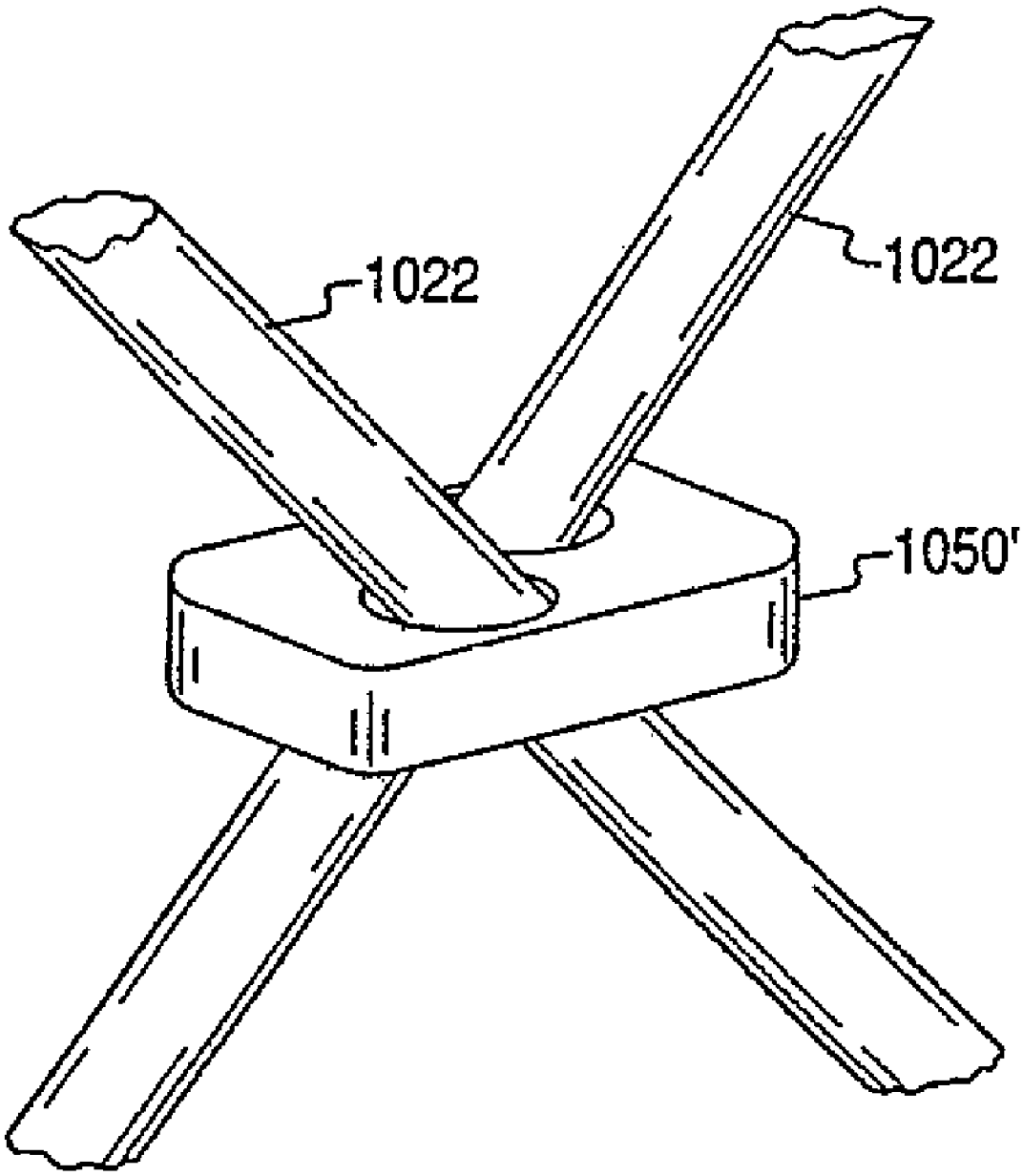
FIG. 25 is a perspective view illustrating a latch mechanism comprising a block according to an exemplary embodiment of the present invention.

As shown in FIG. 25, as an alternative or in addition to a latch mechanism 1050 which engages one of the pivot joints 1040, the latch mechanism may comprise a block 1050' that surrounds the intersection of the cross members 1022 of a pair of cross members 1022. An inner surface of the block 1050' prevents the cross members 1022 from pivoting past a predetermined angle between the cross members 1022 of the pair by engaging with the cross members 1022.

Returning to FIGS. 21 and 22, the frame structure may also include a number of rails 1060 that extend between the legs 1018. The rails 1060 extend between respective adjacent legs 1018 and are secured to respective pivot joints 1024 in a similar fashion to the rails 60 or rails 160 described above.

The rails 1060 may be flexible and may be made of the same material as the rails 60 or 160 described above. Alternatively, the rails may comprise two stiff sections 1062 and 1064 with a fold mechanism 1066 intermediate to and separating the stiff sections 1062 and 1064 in a fashion similar to the fold mechanism 66 described above.

Figure 26:
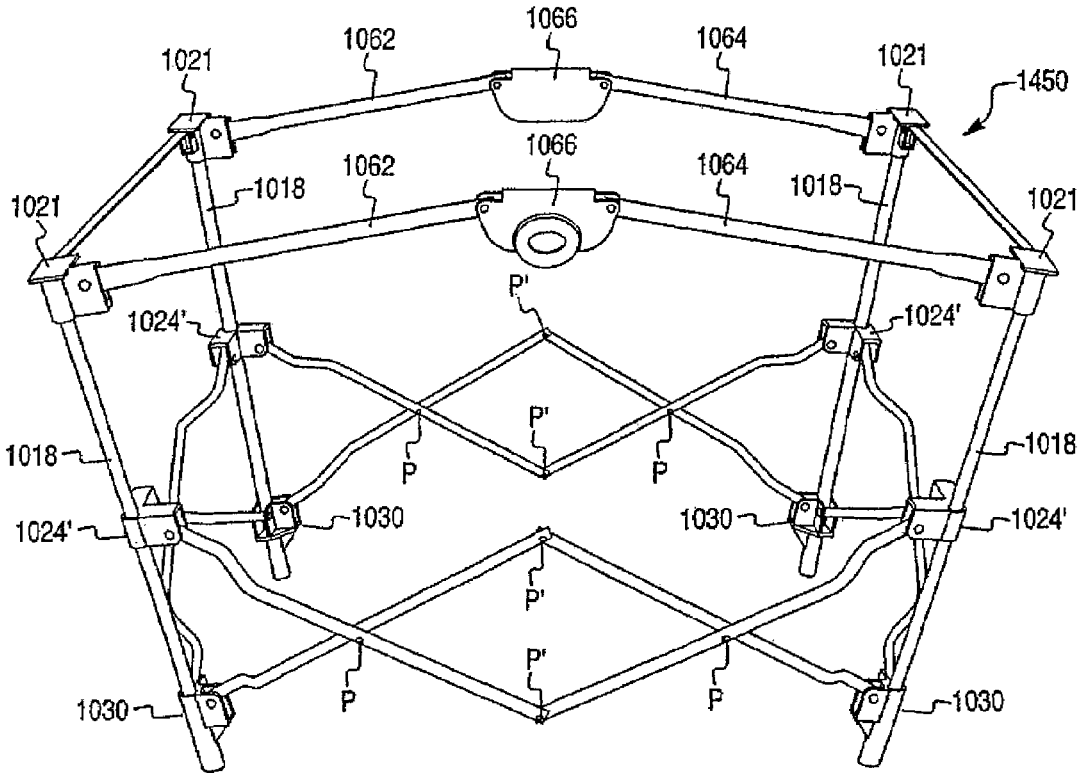
FIG. 26 is a perspective view illustrating a collapsible frame structure in an open arrangement according to another exemplary embodiment of the present invention.

FIG. 21 illustrates a frame structure 1000 with flexible rails 1060. FIG. 26 illustrates a frame structure 1450 with a rail having a particular fold mechanism 1066. The fold mechanism 1066 may comprise, for example, a hinge, a fold latch, or a simple pivot assembly. Examples of appropriate fold latches are disclosed in, for example, U.S. patent application Ser. No. 09/969,498 entitled "TOP RAIL LATCH FOR FOLDING PLAYARD" filed on Oct. 3, 2001, now abandoned, and published on Apr. 3, 2003 as PG publication No. U.S. 2003/0061658 A1, which is hereby incorporated by reference.

The frame structure 1450 as shown in FIG. 26 includes a number of rail joints 1021 on respective legs 1018 to attach to the rails therebetween. The pivot joints 1024' and 1030, arranged below the rail joints 1021, are pivotably connected to respective cross members 1022. In this arrangement, the fabric enclosure of the playard can include a bumper pad that fits adjacent the cross members 922, and can include mesh at the top of the enclosure, extending between the slider joints 930 and the top rails for example.

Figure 27:
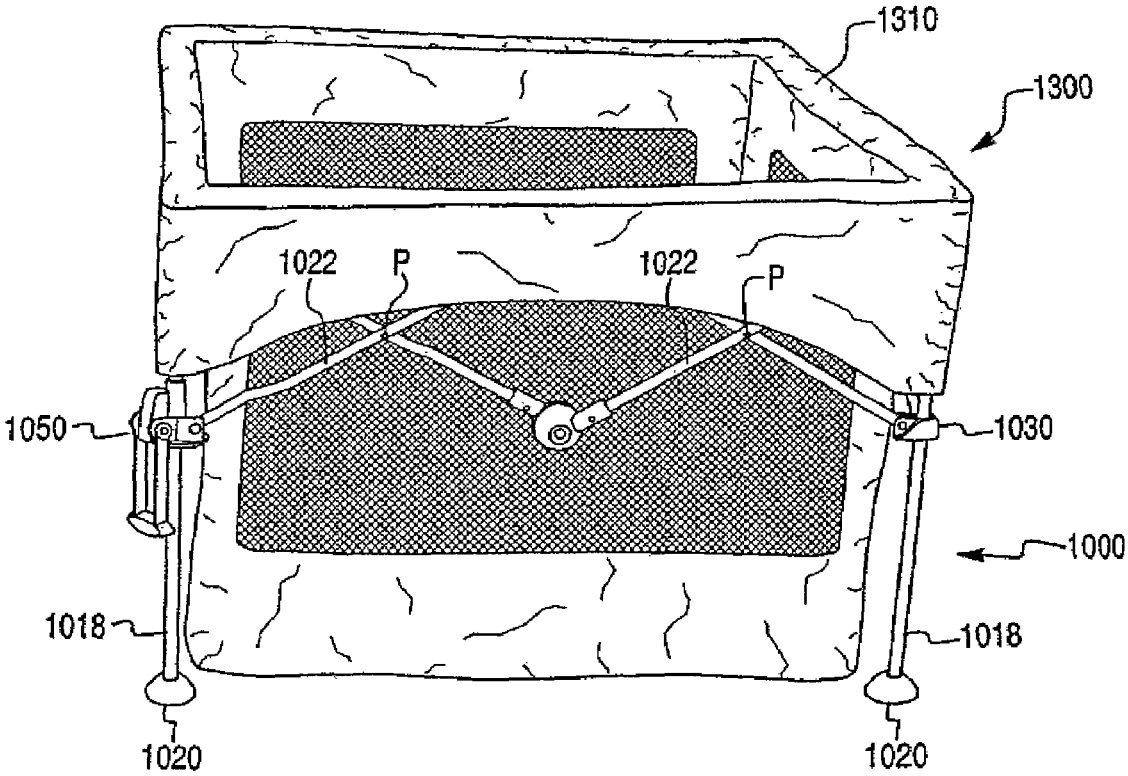
FIG. 27 is a perspective view illustrating a playard that incorporates the collapsible frame structure of FIG. 21 according to an exemplary embodiment of the present invention.

FIG. 27 illustrates a playard structure 1300 comprising the collapsible frame structure 1000 of the embodiment of FIGS. 21 and 22, along with a fabric enclosure 1310 mounted to and supported by the collapsible frame structure. Beneficially, the collapsible frame structure 1000 is movable between a folded arrangement and an open arrangement with the fabric enclosure 1310 mounted thereto. Therefore, there is no need to remove the fabric enclosure 1310 prior to moving the collapsible frame structure 1000 from the open arrangement to the folded arrangement. Further, there is no need to attach the fabric enclosure 1310 only after the collapsible frame structure 1000 is moved to the open arrangement. Thus, the ease of use of the playard structure is increased. Of course, while it is not required to remove the fabric enclosure 1310 prior to folding the collapsible frame structure 1000, a user may do so if desired, such as to the clean the fabric enclosure 1310. In this arrangement, the fabric enclosure of the playard can include a bumper pad that fits adjacent the cross members 1022, and can include mesh at the top of the enclosure, extending between the pivot joints 1030 and the rails for example.

While FIG. 27 illustrates the playard structure 1300 with the collapsible frame structure 1000 of the embodiment of FIGS. 21 and 22, the frame structure alternatively could be the frame structure 1450 of FIG. 26.

FIG. 28 illustrates another embodiment of a collapsible frame structure 1400, which includes a plurality of flexible rails 1060 such that when the collapsible frame structure 1400 is in the open arrangement, each rail 1060 is tensioned so as to prevent the collapsible frame structure from further opening. This embodiment is similar to earlier embodiments described above, in that a plurality of cross members 1022 are arranged to form sides of the frame structure 1400. In addition, each pair of cross members may be pivotally connected at pivots P so that, when the frame structure 1400 is collapsed to the folded arrangement, the cross members 1022 can pivot relative to each other. The frame structure 1400 also includes a plurality of pivot joints grouped as first pivot joints 1024 and second pivot joints 1070. Each of the first pivot joints 1024 is pivotably attached to two adjacent cross members 1022, and each of the second pivot joints 1070 is also attached to two adjacent cross members 1022. Each of the rails 1060 is preferably fixedly attached to two adjacent first pivot joints 1024. The rails 1060 are preferably not detachably attached to the two adjacent first pivot joints 1024 so that the attachment is more secure. When the collapsible frame structure 1400 is in the open arrangement, each rail 1060 is tensioned so as to prevent the collapsible frame structure 1400 from further opening. As an alternative to the flexible rails 1060, the rails may be comprise two stiff sections with a fold mechanism intermediate thereto as described above with respect to earlier embodiments.

In addition to the flexible rails 1060, which are arranged as top rails connecting the first pivot joints 1024, the frame structure 1400 may also include a number of flexible bottom rails 1061, if desired, attached to two adjacent second pivot joints 1070. The bottom rails 1061 provide additional tensioning to prevent the collapsible frame structure 1400 from further opening.

The second pivot joints 1070 may act as feet of the collapsible frame structure 1400. When the collapsible frame structure 1400 rests on a surface in the open arrangement, the second pivot joints 1070 contact the surface. In this regard, the second pivot joints 1070 may have flat surfaces on their bottom to improve stability.

The pivot joints 1024 may be similar to the pivot joints 24 described above with respect to FIGS. 2-4 and 17 or pivot joints 140 described above with respect to FIGS. 18-20, for example. The pivot joints 1070 may be similar to the pivot joints 24 described above with respect to FIGS. 24 and 17, except that the pivot joints 1070 are arranged at the bottom of the legs 1018 to act as feet.

In the frame structure 1400 illustrated in FIG. 28, each of the second pivot joints 1070 is arranged below a respective one of the first pivot joints 1024, yet the frame structure lacks any frame elements to interconnect the second pivot joints 1070 to the respective first pivot joints 1024. There is no frame structure, such as legs for example, between the first pivot joints 1024 and the second pivot joints 1070. Thus, the frame structure 1400 has a simple design.

Each second pivot joint 1070 may be directly below a respective first pivot joint 1024, or may be merely below a respective first pivot joint 1024.

Alternatively, the frame structure 1400 may include frame elements to interconnect the second pivot joints 1070 to respective first pivot joints 1024, such as legs for example. In this case, the second pivot joints 1070 may be feet that slidingly engage respective of the legs 1018.

Figure 29:
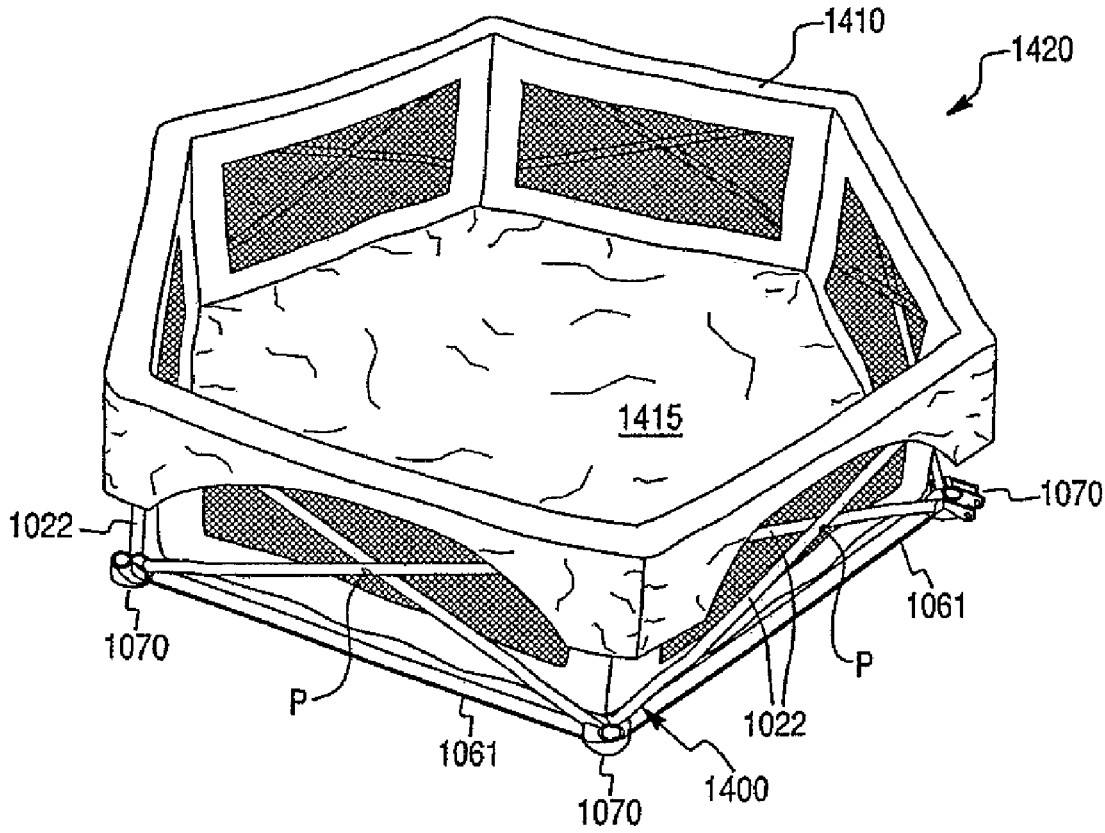
FIG. 29 is a perspective view illustrating a playard that incorporates the collapsible frame structure of FIG. 28 according to an exemplary embodiment of the present invention.

FIG. 29 illustrates a playard 1420 comprising the frame structure 1400 described above with a fabric enclosure 1410 mounted to and supported by the collapsible frame structure. The fabric enclosure 1410 has a base portion 1415 configured such that the weight of an occupant on the base portion provides additional tension to each rail 1060. In this way, when an occupant, such as a child, is within the playard 1420 and supported by the base portion 1415, the weight of the occupant provides further tension to prevent the collapsible frame structure 1400 from further opening.

Figure 30:
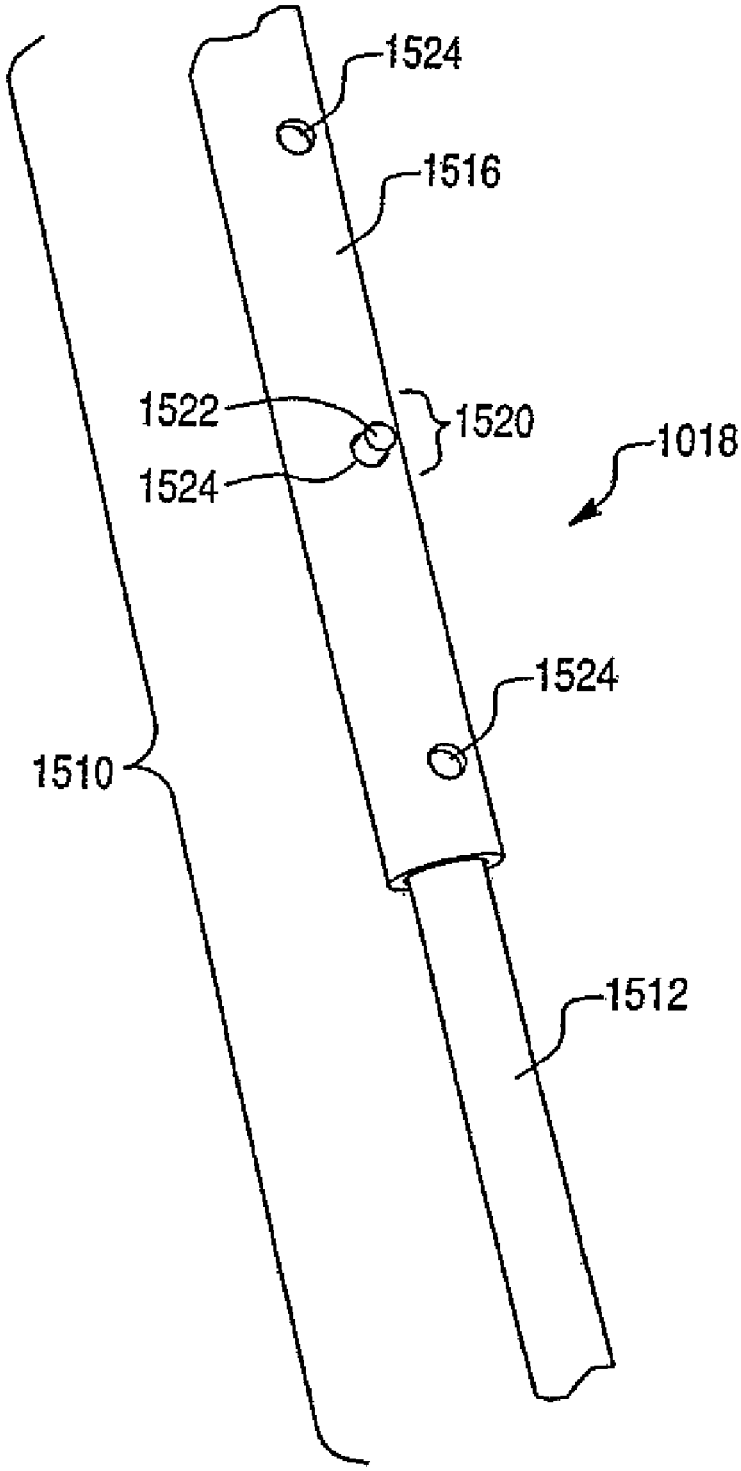
FIG. 30 is a view illustrating a telescoping and locking mechanism for a leg of a frame structure according to an exemplary embodiment of the present invention.

The legs 18 or 1018 of the frame structures described above may also include a telescoping mechanism configured to allow the length of the leg to be adjusted and a locking mechanism configured to lock the leg at a predetermined height. FIG. 30 illustrates a portion of a leg 18 (or 1018) illustrating a telescoping mechanism 15l0 and locking mechanism 1520. The telescoping mechanism 1510 includes a first leg portion 1512 and a second leg portion 1516. The first leg portion 1512 has an outer surface 1514 configured to fit within an inner surface 1518 of the second leg portion 1516. In this manner the first leg portion 1512 may be slid within the second leg portion 1516.

The locking mechanism 1520 allows the leg 18 to be locked at a predetermined height. The locking mechanism 1520 may comprise, for example, a snap button 1522, such as a Valco button, on one of the first leg portion 1512 and the second leg portion 1516 and at least two holes 1524 on the other of the first leg portion 1512 and the second leg portion 1516. The snap button 1522 is shaped so as to fit in each of the holes 1524. When the first leg portion 1512 and the second leg portion 1516 are slid with respect to each other so that the snap button 1522 aligns with one of the holes 1524, the snap button 1522 is biased so as to slide in and engage the aligned hole 1524. A user may manually disengage the snap button 1522 from one of the holes 1524 by pressing on the snap button 1524 with a finger.

As an alternative to manually disengaging the snap button 1522 with a finger to adjust the leg length, a lock actuator may be used. One example of a lock actuator is as follows. The lock actuator may comprise three portions that slide over the leg 18, where the three portions are a slider mounted to the leg 18, a non-rotatable hub coupled to the slider, and a rotatable hub coupled to the non-rotatable hub. The slider allows the lock actuator to be easily slid up and down the leg 18. The non-rotatable hub provides an interface between the slider and the rotatable hub. An actuator of the rotatable hub is biased out of alignment with any of the holes 1524. To align the actuator of the rotatable hub with a hole 18, the hub may be manually rotated against the bias. The actuator of the rotatable hub may be a ramp, for example, that engages a snap button 1522 to push the snap button 1522 out of engagement with a hole 1524 The first leg portion 1512 then may be slid relative to the second leg portion 1516 to adjust the leg length. As another example, the actuator of the rotatable hub may be a button, for example, which may be depressed against a 1524 to push the protrusion out of engagement with the hole 1522.

The preferred embodiments have been set forth herein for the purpose of illustration. This description, however, should not be deemed to be a limitation on the scope of the invention.

Various modifications, adaptations, and alternatives may occur to one skilled in the art without departing from the claimed inventive concept. The true scope and spirit of the invention are indicated by the following claims.

What is claimed is:

1. A playard, comprising:

a frame structure movable between an open arrangement and a folded arrangement, the frame structure comprising:

a plurality of pivot joints arranged in an upper set and a lower set; and a plurality of cross members connected to the upper and lower sets of pivot joints;

a plurality of top rails, each top rail being attached to adjacent pivot joints in the upper set and comprising a fabric webbing; and a plurality of bottom rails, each bottom rail being attached to two adjacent pivot joints in the lower set, wherein each pivot joint in the lower set comprises a foot configured to engage a surface upon which the frame structure rests;

wherein the plurality of cross members are arranged on respective slants as booms to support the upper set of pivot joints at an elevation above the lower set of pivot joints, the elevation decreasing as the frame structure moves from the folded arrangement to the open arrangement until the top rails are under tension.

2. A playard according to claim 1, wherein each top rail is flexible.

3. A playard according to claim 1, wherein the plurality of cross members are arranged in pairs arranged in an X-shape to define respective sides of the frame structure, and wherein the frame structure lacks any components within an interior space of the frame structure defined by the sides.

4. A playard according to claim 1, wherein each pivot joint in the upper set is disposed over a respective pivot joint in the lower set.

5. A playard according to claim 4, wherein the frame structure lacks legs to support the upper set of pivot joints above the lower set of pivot joints.

6. A playard according to claim 1, wherein each top rail comprises a fold mechanism and a pair of stiff sections coupled via the fold mechanism.

7. A playard according to claim 1, further comprising a fabric enclosure supported by the frame structure, the fabric enclosure having a base portion suspended from the plurality of top rails such that weight of a child upon the base portion produces additional tension in each top rail.

8. A playard, comprising:

a frame structure movable between an open arrangement and a folded arrangement, the frame structure comprising:

a plurality of pivot joints arranged in an upper set and a lower set, each pivot joint in the upper set being positioned over a corresponding pivot joint in the lower set; and a plurality of cross members connected at respective slants to the upper and lower sets of pivot joints;

a plurality of top rails, each top rail being attached to adjacent pivot joints in the upper set and comprising a fabric webbing; and a plurality of bottom rails, each bottom rail being attached to two adjacent pivot joints in the lower set, wherein each pivot joint in the lower set comprises a foot configured to engage a surface upon which the frame rests;

wherein the frame structure lacks legs to support the upper set of pivot joints at an elevation above the lower set of pivot joints, the elevation decreasing as the respective slants of the cross members change to move the frame structure from the folded arrangement to the open arrangement until the top rails are under tension.

9. A playard according to claim 8, wherein each top rail is flexible.

10. A playard according to claim 8, wherein the plurality of cross members are arranged in pairs arranged in an X-shape to define respective sides of the frame structure, and wherein the frame structure lacks any components within an interior space of the frame structure defined by the sides.

11. A playard according to claim 8, wherein the plurality of cross members are arranged on the respective slants as booms to support the upper set of pivot joints above the lower set of pivot joints.

12. A playard according to claim 8, wherein each top rail comprises a fold mechanism and a pair of stiff sections coupled via the fold mechanism.

13. A playard according to claim 8, further comprising a fabric enclosure supported by the frame structure, the fabric enclosure having a base portion suspended from the plurality of top rails such that weight of a child upon the base portion produces additional tension in each top rail.

* * * * *